US008253665B2

(12) United States Patent
Nathan et al.

(10) Patent No.: US 8,253,665 B2
(45) Date of Patent: Aug. 28, 2012

(54) METHOD AND SYSTEM FOR DRIVING AN ACTIVE MATRIX DISPLAY CIRCUIT

(75) Inventors: Arokia Nathan, Waterloo (CA); G. Reza Chaji, Waterloo (CA)

(73) Assignee: Ignis Innovation Inc., Ontario (CA)

( * ) Notice: Subject to any disclaimer, the term of this patent is extended or adjusted under 35 U.S.C. 154(b) by 1357 days.

(21) Appl. No.: 11/651,099

(22) Filed: Jan. 9, 2007

(65) Prior Publication Data

US 2008/0088549 A1 Apr. 17, 2008

(30) Foreign Application Priority Data

Jan. 9, 2006 (CA) ..... 2535233
Jun. 27, 2006 (CA) ..... 2551237

(51) Int. Cl.
*G09G 3/32* (2006.01)

(52) U.S. Cl. ..... 345/82; 345/76; 315/169.1; 315/169.2; 315/169.3

(58) Field of Classification Search ..... 345/76, 345/82; 315/169.1–169.3
See application file for complete search history.

(56) References Cited

U.S. PATENT DOCUMENTS 5,748,160 A 5/1998 Shieh et al.
5,952,789 A 9/1999 Stewart et al.
6,229,508 B1 5/2001 Kane
6,392,617 B1 5/2002 Gleason
6,501,466 B1 * 12/2002 Yamagishi et al. ..... 345/204
6,734,636 B2 5/2004 Sanford et al.
6,859,193 B1 2/2005 Yumoto
6,919,871 B2 7/2005 Kwon
2002/0195968 A1 12/2002 Sanford et al.
2003/0062844 A1 4/2003 Miyazawa ..... 315/169.3
2003/0098829 A1 * 5/2003 Chen et al. ..... 345/82
2003/0111966 A1 6/2003 Mikami et al.
2003/0122747 A1 7/2003 Shannon et al. ..... 345/76
2003/0197663 A1 10/2003 Lee et al.
2004/0070557 A1 4/2004 Asano et al.
2004/0145547 A1 7/2004 Oh
2004/0150595 A1 8/2004 Kasai
2004/0155841 A1 8/2004 Kasai (Continued)

FOREIGN PATENT DOCUMENTS

CA 2438363 2/2005

(Continued)

OTHER PUBLICATIONS

Chaji et al., "52.2: A Low-Cost Stable Amorphous Silicon AMOLED Display with Full $V_T$- and $V_{OLED}$ Shift Compensation," SID 2007, 2007 SID International Symposium, Society for Information Display, Los Angeles, USA, vol. XXXVIII, pp. 1580-1583 (May 20, 2007).

(Continued)

*Primary Examiner* — Nitin Patel
*Assistant Examiner* — Saifeldin Elnafia
(74) *Attorney, Agent, or Firm* — Nixon Peabody LLP

(57) ABSTRACT

A method and system for driving an active matrix display is provided. The system includes a drive circuit for a pixel having a light emitting device. The drive circuit includes a drive transistor for driving the light emitting device. The system includes a mechanism for adjusting the gate voltage of the drive transistor.

31 Claims, 38 Drawing Sheets

U.S. PATENT DOCUMENTS

| | | | | |
|---|---|---|---|---|
| 2004/0252089 | A1* | 12/2004 | Ono et al. | 345/82 |
| 2005/0007357 | A1 | 1/2005 | Yamashita et al. | |
| 2005/0083270 | A1 | 4/2005 | Miyazawa | 345/76 |
| 2005/0258867 | A1 | 11/2005 | Miyazawa | 326/83 |
| 2005/0285825 | A1 | 12/2005 | Eom et al. | |
| 2006/0139253 | A1* | 6/2006 | Choi et al. | 345/76 |

FOREIGN PATENT DOCUMENTS

| | | | |
|---|---|---|---|
| CA | 2 526 782 | C | 8/2007 |
| EP | 1 429 312 | A | 6/2004 |
| EP | 1 439 520 | A2 | 7/2004 |
| EP | 1 517 290 | A2 | 3/2005 |
| JP | 2004-054188 | | 2/2004 |
| JP | 2005-099715 | | 4/2005 |
| JP | 2005-338819 | | 12/2005 |

OTHER PUBLICATIONS

EPO Communication with Supplemental European Search Report for EP Application No. 07701644.2, dated Aug. 18, 2009 (12 pages).
Alexander et al.: "Pixel circuits and drive schemes for glass and elastic AMOLED displays"; dated Jul. 2005 (9 pages).
Chahi et al.: "An Enhanced and Simplified Optical Feedback Pixel Circuit for AMOLED Displays"; dated Oct. 2006.
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "eUTDSP: a design study of a new VLIW-based DSP architecture"; dated My 2003 (4 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost Stable a-Si:H AMOLED Display for Portable Applications"; dated Jun. 2006 (4 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
European Search Report for European Application No. EP 07 70 1644 dated Aug. 5, 2009.
International Search Report for International Application No. PCT/CA2007/000013 dated May 7, 2007.
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Partial European Search Report mailed May 30, 2012 which issued in corresponding European patent application No. 12156251.6 (7 pages).

* cited by examiner

190

P: Programming Cycle
C: Compensation Cycle
D: Driving Cycle

METHOD AND SYSTEM FOR DRIVING AN ACTIVE MATRIX DISPLAY CIRCUIT

CROSS-REFERENCE TO RELATED APPLICATION(S)

This application claims priority to Canadian Patent Application Ser. No. 2,535,233, filed on Jan. 9, 2006, and Canadian Patent Application Ser. No. 2,551,237, filed on Jun. 27, 2006, which are herein incorporated by reference.

FIELD OF INVENTION

The invention relates to a light emitting device, and more specifically to a method and system for driving a pixel circuit having a light emitting device.

BACKGROUND OF THE INVENTION

Electro-luminance displays have been developed for a wide variety of devices, such as cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, the pixel circuit of the AMOLED should be capable of providing an accurate and constant drive current.

There is a need to provide a method and system that is capable of providing constant brightness with high accuracy and reducing the effect of the aging of the pixel circuit and the instability of backplane and a light emitting device.

SUMMARY OF THE INVENTION

It is an object of the invention to provide a method and system that obviates or mitigates at least one of the disadvantages of existing systems.

In accordance with an aspect of the present invention there is provided a system a display system, including a drive circuit for a pixel having a light emitting device. The drive circuit includes a drive transistor connected to the light emitting device. The drive transistor includes a gate terminal, a first terminal and a second terminal. The drive circuit includes a first transistor including a gate terminal, a first terminal and a second terminal, the gate terminal of the first transistor being connected to a select line, the first terminal of the first transistor being connected to a data line, the second terminal of the first transistor being connected to the gate terminal of the drive transistor. The drive circuit includes a circuit for adjusting the gate voltage of the drive transistor, the circuit including a discharging transistor having a gate terminal, a first terminal and a second terminal, the gate terminal of the discharging transistor being connected to the gate terminal of the drive transistor at a node, the voltage of the node being discharged through the discharging transistor. The drive circuit includes a storage capacitor including a first terminal and a second terminal the first terminal of the storage capacitor being connected to the gate terminal of the drive transistor at the node.

The display system may include a display array having a plurality of pixel circuits arranged in rows and columns, each of the pixel circuits including the drive circuit and a driver for driving the display array. The gate terminal of the second transistor is connected to a bias line. The bias line may be shared by more than one pixel circuit of the plurality of pixel circuits.

In accordance with a further aspect of the present invention there is provided a method for the display system. The display system includes a driver for providing a programming cycle, a compensation cycle and a driving cycle for each row. The method includes the steps of at the programming cycle for a first row, selecting the address line for the first row and providing programming data to the first row, at the compensation cycle for the first row, selecting the adjacent address line for a second row adjacent to the first row and disenabling the address line for the first row, and at the driving cycle for the first row, disenabling the adjacent address line.

In accordance with a further aspect of the present invention there is provided a display system, including one or more than one pixel circuit, each including a light emitting device and a drive circuit. The drive circuit includes a drive transistor including a gate terminal, a first terminal and a second terminal, the drive transistor being between the light emitting device and a first power supply. The drive circuit includes a switch transistor including a gate terminal, a first terminal and a second terminal, the gate terminal of the switch transistor being connected to a first address line, the first terminal of the switch transistor being connected to a data line, the second terminal of the switch transistor being connected to the gate terminal of the drive transistor. The drive circuit includes a circuit for adjusting the gate voltage of the drive transistor, the circuit including a sensor for sensing energy transfer from the pixel circuit and a discharging transistor, the sensor having a first terminal and a second terminal, a property of the sensor varying in dependence upon the sensing result, the discharging transistor having a gate terminal, a first terminal and a second terminal, the gate terminal of the discharging transistor being connected to a second address line, the first terminal of the discharging transistor being connected to the gate terminal of the drive transistor at a node, the second terminal of the discharging transistor being connected to the first terminal of the sensor. The drive circuit includes a storage capacitor including a first terminal and a second terminal, the first terminal of the storage capacitor being connected to the gate terminal of the drive transistor at the node.

In accordance with a further aspect of the present invention there is provided a method for a display system, including the step of implementing an in-pixel compensation.

In accordance with a further aspect of the present invention there is provided a method for a display system, including the step of implementing an of-panel compensation.

In accordance with a further aspect of the present invention there is provided a method for a display system, which includes a pixel circuit having a sensor, including the step of reading back the aging of the sensor.

In accordance with a flier aspect of the present invention there is provided a display system, including a display array including a plurality of pixel circuits arranged in rows and columns, each including a light emitting device and a drive circuit; and a drive system for driving the display array. The drive circuit includes a drive transistor including a gate terminal, a first terminal and a second terminal, the drive transistor being between the light emitting device and a first power supply. The drive circuit includes a first transistor including a gate terminal, a first terminal and a second terminal, the gate terminal of the first transistor being connected to an address line, the first terminal of the first transistor being connected to a data line, the second terminal of the first transistor being connected to the gate terminal of the drive transistor. The drive circuit includes a circuit for adjusting the gate voltage of the drive transistor, the circuit including a second transistor, the second transistor having a gate terminal, a first terminal and a second terminal, the gate terminal of the second transistor being connected to a control line, the first terminal of the second transistor being connected to the gate terminal of the drive transistor. The drive circuit includes a storage capacitor including a first terminal and a second terminal, the first terminal of the storage capacitor being connected to the gate terminal of the drive transistor. The drive system drives the pixel circuit so that the pixel circuit is turned off for a portion of a frame time.

In accordance with a further aspect of the present invention there is provided a method for a display system having a display array and a driver system. The drive system provides a frame time having a programming cycle, a discharge cycle, an emission cycle, a reset cycle, and a relaxation cycle, for each row. The method includes the steps of at the programming cycle, programming the pixel circuits on the row by activating the address line for the row; at the discharge cycle, partially discharging the voltage on the gate terminal of the drive transistor by deactivating the address line for the row and activating the control line for the row; at the emission cycle, deactivating the control line for the row, and controlling the light emitting device by the drive transistor; at the reset cycle, discharging the voltage on the gate term of the drive transistor by activating the control line for the row; and at the relaxation cycle, deactivating the control line for the row.

BRIEF DESCRIPTION OF THE DRAWINGS

These and other features of the invention will become more apparent from the following description in which reference is made to the appended drawings wherein.

DETAILED DESCRIPTION

Figure 1:
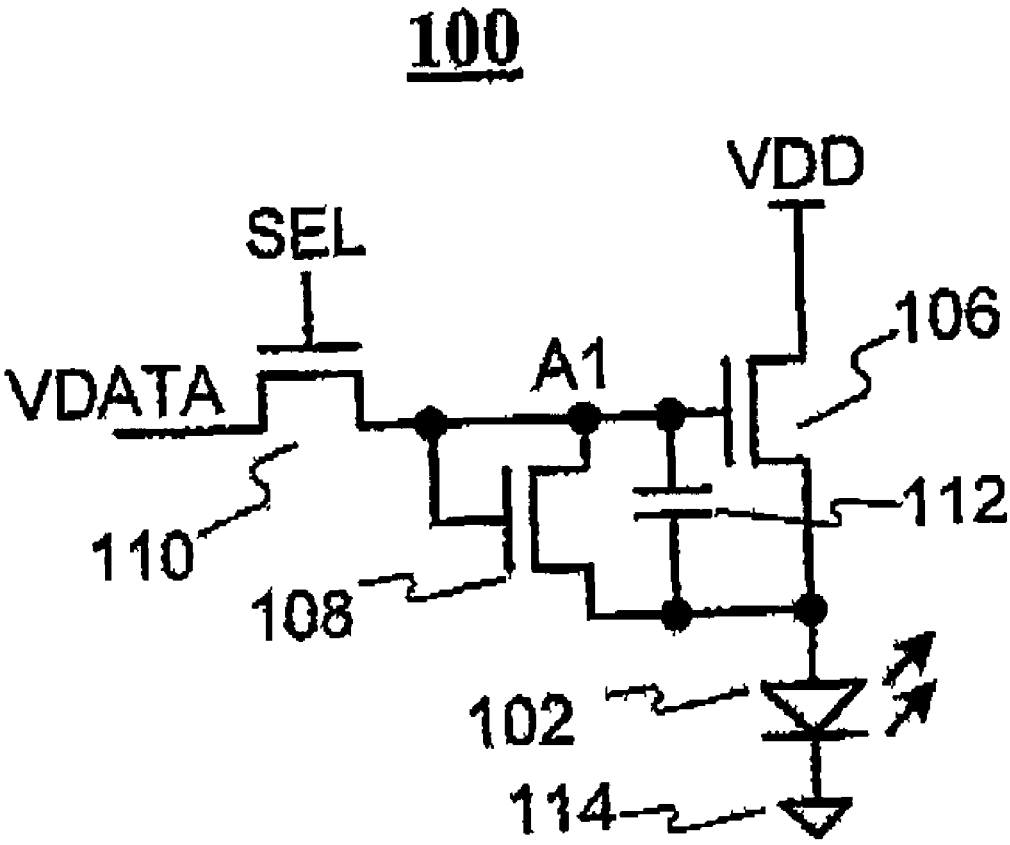
FIG. 1 is a diagram illustrating an example of a pixel circuit to which a pixel drive scheme in accordance with an embodiment of the present invention is applied.

FIG. 1 illustrates an example of a pixel circuit to which a pixel drive scheme in accordance with an embodiment of the present invention is applied. The pixel circuit 100 of FIG. 1 includes an OLED 102 and a drive circuit 104 for driving the OLED 102. The drive circuit 104 includes a drive transistor 106, a discharging transistor 108, a switch transistor 110, and a storage capacitor 112. The OLED 102 includes, for example, an anode electrode, a cathode electrode and an emission layer between the anode electrode and the cathode electrode.

In the description below, "pixel circuit" and "pixel" are used interchangeably. In the description below, "signal" and "line" may be used interchangeably. In the description below, the terms "line" and "node" may be used interchangeably. In the description, the terms "select line" and "address line" may be used interchangeably. In the description below, "connect (or connected)" and "couple (or coupled)" may be used interchangeably, and may be used to indicate that two or more elements are directly or indirectly in physical or electrical contact with each other.

In one example, the transistors 106, 108 and 110 are n-type transistors. In another example, the transistors 106, 108 and 110 are p-type transistors or a combination of n-type and p-type transistors. In one example, each of the transistors 106, 108 and 110 includes a gate terminal, a source terminal and a drain terminal.

The transistors 106, 108 and 110 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 106 is provided between a voltage supply line VDD and the OLED 102. One terminal of the drive transistor 106 is connected to VDD. The other terminal of the drive transistor 106 is connected to one electrode (e.g., anode electrode) of the OLED 102. One terminal of the discharging transistor 108 and its gate terminal are connected to the gate terminal of drive transistor 106 at node A1. The other terminal of the discharging transistor 108 is connected to the OLED 102. The gate termini of the switch transistor 110 is connected to a select line SEL. One terminal of the switch transistor 110 is connected to a data line VDATA. The other terminal of the switch transistor 110 is connected to node A1. One terminal of the storage capacitor 112 is connected to node A1. The other terminal of the storage capacitor 112 is connected to the OLED 102. The other electrode (e.g., cathode electrode) of the OLED 102 is connected to a power supply line (e.g., common ground) 114.

The pixel circuit 100 provides constant averaged current over the frame time by adjusting the gate voltage of the drive transistor 106, as described below.

Figure 2:
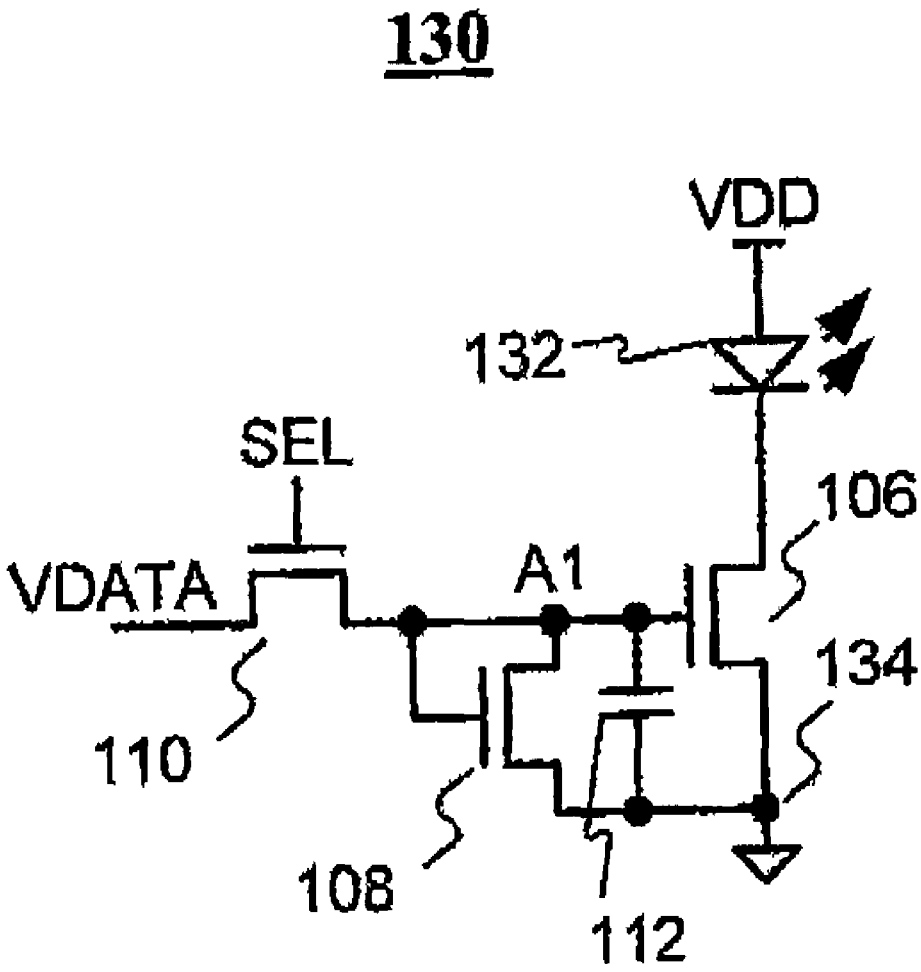
FIG. 2 is a diagram illustrating another example of a pixel circuit having a drive circuit of FIG. 1.

FIG. 2 illustrates anther example of a pixel circuit having the drive circuit 104 of FIG. 1. The pixel circuit 130 is similar to the pixel circuit 100 of FIG. 1. The pixel circuit 130 includes an OLED 132. The OLED 132 may be same or similar to the OLED 102 of FIG. 1. In the pixel circuit 130, the drive transistor 106 is provided between one electrode (e.g., cathode electrode) of the OLED 132 and a power supply line (e.g., common ground) 134. One terminal of the discharging transistor 138 and one terminal of the storage capacitor 112 are connected to the power supply line 134. The other electrode (e.g., anode electrode) of the OLED 132 is connected to VDD.

The pixel circuit 130 provides constant averaged current over the frame time, in a manner similar to that of the pixel circuit 100 of FIG. 1.

Figure 3:
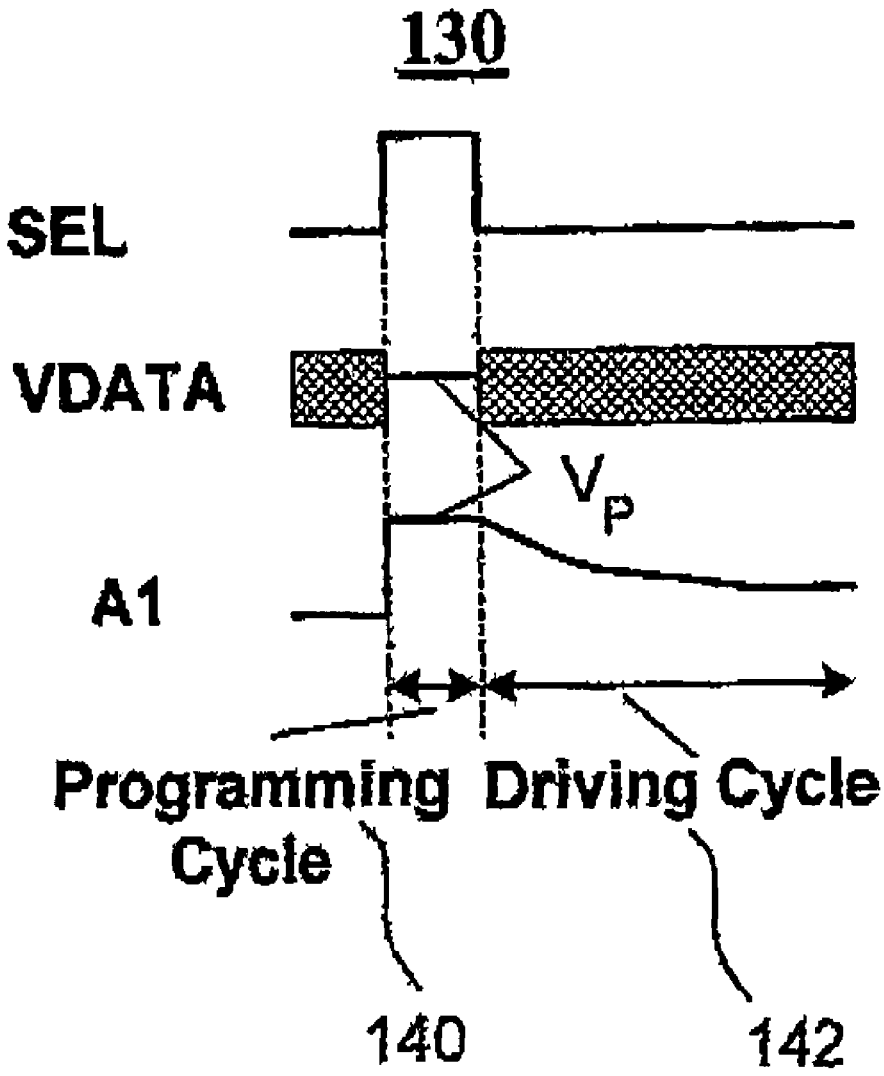
FIG. 3 is a timing diagram for an example of a method of driving a pixel circuit in accordance with an embodiment of the present invention.

FIG. 3 illustrates an example of method of driving a pixel circuit in accordance with an embodiment of the present invention. The waveforms of FIG. 3 are applied to a pixel circuit (e.g., 100 of FIG. 1, 130 of FIG. 2) having the drive circuit 104 of FIGS. 1 and 2.

The operation cycle of FIG. 3 includes a programming cycle 140 and a driving cycle 142. Referring to FIGS. 1 to 3, during the programming cycle 140, node A1 is charged to a programming voltage through the switch transistor 110 while the select line SEL is high. During the driving cycle 142, node A1 is discharged through the discharging transistor 108. Since the drive transistor 106 and the discharging transistor 108 have the same bias condition, they experience the same threshold voltage shift. Considering that the discharge time is a function of transconductance of the discharging transistor 108, the discharge time increases as the threshold voltage of the drive transistor 106/the discharging transistor 108 increases. Therefore, the average current of the pixel (100 of FIG. 1, 130 of FIG. 2) over the frame time remains constant. In an example, the discharging transistor is a very weak transistor with short width (W) and long channel length (L). The ratio of the width (W) to the length (L) may change based on different situations.

In addition, in the pixel circuit 130 of FIG. 2, an increase in the OLED voltage for the OLED 132 results in longer discharge time. Thus, the averaged pixel current will remain constant even after the OLED degradation.

Figure 4:
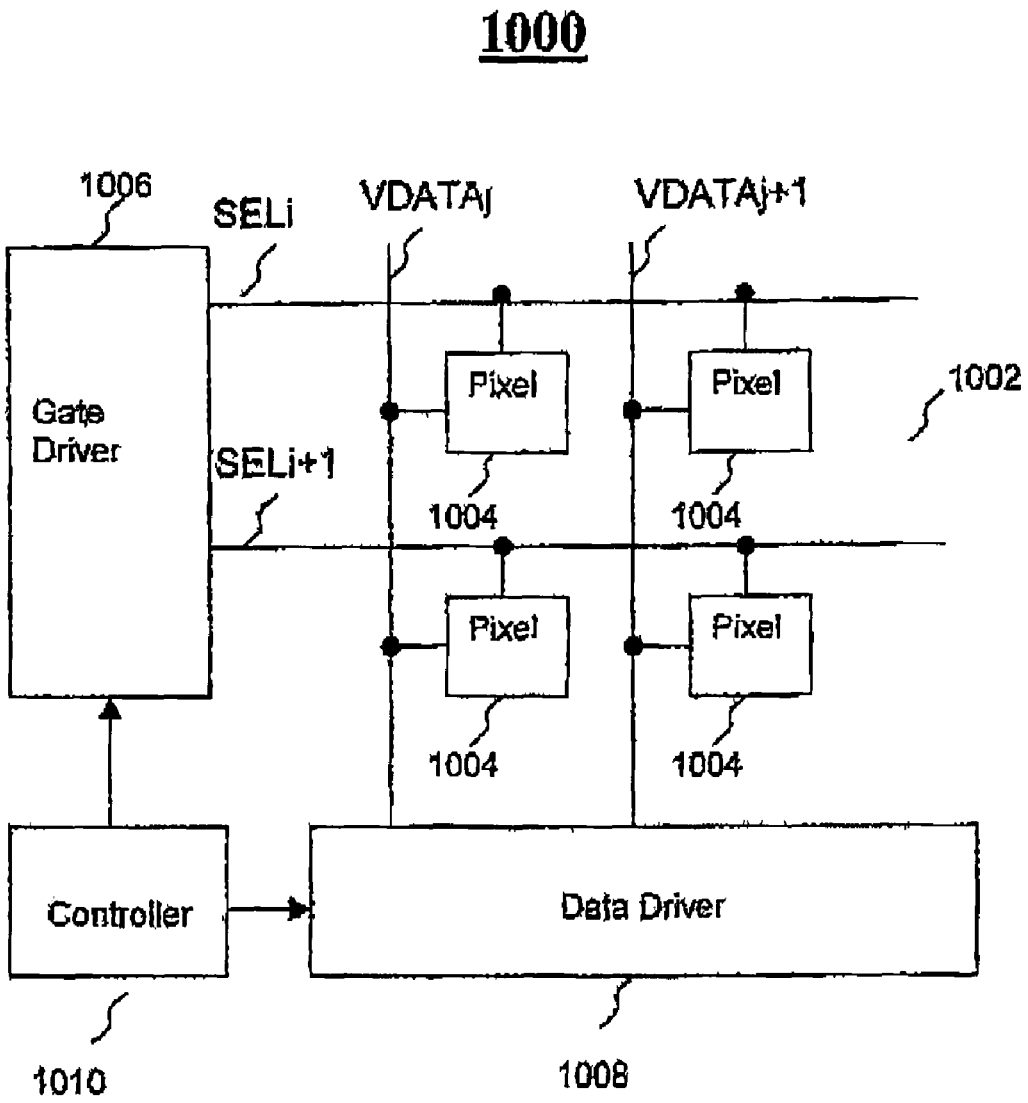
FIG. 4 is a diagram illustrating an example of a display system for the drive circuit of FIGS. 1 and 2.

FIG. 4 illustrates an example of a display system for the drive circuit of FIGS. 1 and 2. The display system 1000 of FIG. 4 includes a display array 1002 having a plurality of pixels 1004. The pixel 1004 includes the drive circuit 104 of FIGS. 1 and 2, and may be the pixel circuit 100 of FIG. 1 or the pixel circuit 130 of FIG. 2.

The display array 1002 is an active matrix light emitting display. In one example, the display array 1002 is an AMOLED display array. The display array 1002 may be a single color, multi-color or a fully color display, and may include one or more than one electroluminescence (EL) element (e.g., organic EL). The display array 1002 may be used in mobiles, personal digital assistants (PDAs), computer displays, or cellular phones.

Select lines SELi and SELi+1 and data lines VDATAj and VDATAj+1 are provided to the display array 1002. Each of the select lines SELi and SELi+1 corresponds to SEL of FIGS. 1 and 2. Bach of the data lines VDATAj and VDATAj+1 corresponds to VDATA of FIGS. 1 and 2. The pixels 1004 are arranged in rows and columns. The select line (SELi SELi+1) is shared between common row pixels in the display array 1002. The data line (VDATAj, VDATAj+1) is shared between common column pixels in the display array 1002.

In FIG. 4, four pixels 1004 are shown. However, the number of the pixels 1004 may vary in dependence upon the system design, and does not limited to four. In FIG. 4, two select lines and two data lines are shown. However, the number of the select lines and the data lines may vary in dependence upon the system design, and does not limited to two.

A gate driver 1006 drives SELi and SELi+1. The gate driver 1006 may be an address driver for providing address signals to the address lines (e.g., select lines). A data driver 1008 generates a programming data and drives VDATAj and VDATAj+1. A controller 1010 controls the drivers 1006 and 1008 to drive the pixels 1004 as described above.

Figure 5:
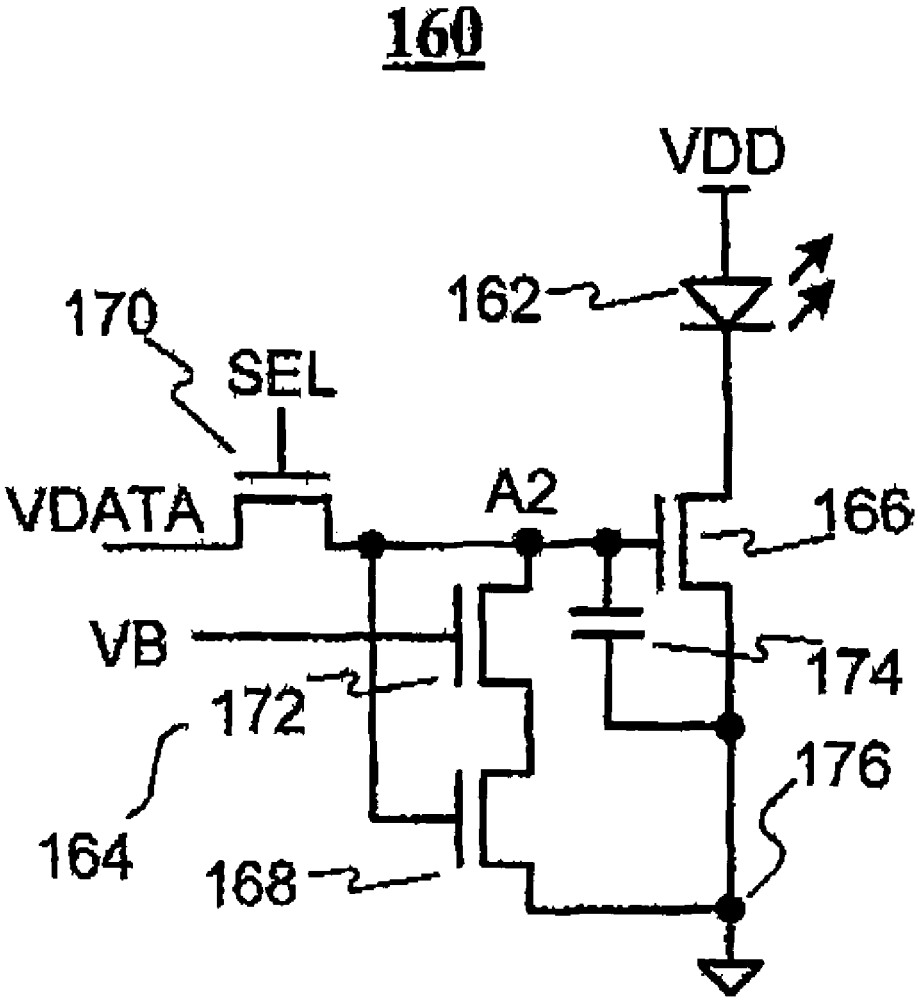
FIG. 5 is a diagram illustrating an example of a pixel circuit to which a pixel drive scheme in accordance with another embodiment of the present invention is applied.

FIG. 5 illustrates an example of a pixel circuit to which a pixel drive scheme in accordance with another embodiment of the present invention. The pixel circuit 160 of FIG. 5 includes an OLED 162 and a drive circuit 164 for driving the OLED 162. The drive circuit 164 includes a drive transistor 166, a discharging transistor 168, first and second switch transistors 170 and 172, and a storage capacitor 174.

The pixel circuit 160 is similar to the pixel circuit 130 of FIG. 2. The drive circuit 164 is similar to the drive circuit 104 of FIGS. 1 and 2. The transistors 166, 168 and 170 correspond to the transistors 106, 108 and 110 of FIGS. 1 and 2, respectively. The transistors 166, 163, and 170 may be same or similar to the transistors 106, 108 and 110 of FIGS. 1 and 2. The storage capacitor 174 corresponds to the storage capacitor 112 of FIGS. 1 and 2. The storage capacitor 174 may be same or similar to the storage capacitor 112 of FIGS. 1 and 2. The OLED 162 corresponds to the OLED 132 of FIG. 2. The OLED 162 may be same or similar to the OLED 132 of FIG. 2.

In one example, the switch transistor 172 is a n-type transistor. In another example, the switch transistor 172 is a p-type transistor. In one example, each of the transistors 166, 168, 170, and 172 includes a gate terminal, a source terminal and a drain terminal.

The transistors 166, 168, 170 and 172 may be fabricated using amorphous silicon, nano/micro crystalline silicon, poly silicon, organic semiconductors technologies (e.g., organic TFT), NMOS/PMOS technology or CMOS technology (e.g., MOSFET).

In the pixel circuit 160, the switch transistor 172 and the discharging transistor 168 are connected in series between the gate terminal of the drive transistor 166 and a power supply line (e.g., common ground) 176. The gate terminal of the switch transistor 172 is connected to a bias voltage line VB. The gate terminal of the discharging transistor 168 is connected to the gate terminal of the drive transistor at node A2. The drive transistor 166 is provided between one electrode (e.g., cathode electrode) of the OLED 162 and the power supply line 176. The gate terminal of the switch transistor 170 is connected to SEL. One terminal of the switch transistor 170 is connected to VDATA. The other terminal of the switch transistor 170 is connected to node A2. One terminal of the storage capacitor 174 is connected to node A2. The other terminal of the storage capacitor 174 is connected to the power supply line 176.

The pixel circuit 160 provides constant averaged current over the frame time by adjusting the gate voltage of the drive transistor 166, as described below.

In one example, the bias voltage line VB of FIG. 5 may be shared between the pixels of the entire panel. In another example, the bias voltage VB may be connected to node A2, as show in FIG. 6. The pixel circuit 160A of FIG. 6 includes a drive circuit 164A. The drive circuit 164A is similar to the drive circuit 164 of FIG. 5. However, in the drive circuit 164A, the gate terminal of the switch transistor 172 is connected to node A2. In a further example, the switch transistor 172 of FIG. 5 may be replaced with a resistor, as shown in FIG. 7. The pixel circuit 160B of FIG. 7 includes a drive circuit 164B. The drive circuit 164B is similar to the drive circuit 164 of FIG. 5. However, in the drive circuit 164B, a resistor 178 and the discharging transistor 168 are connected in series between node A2 and the power supply line 176.

Figure 8:
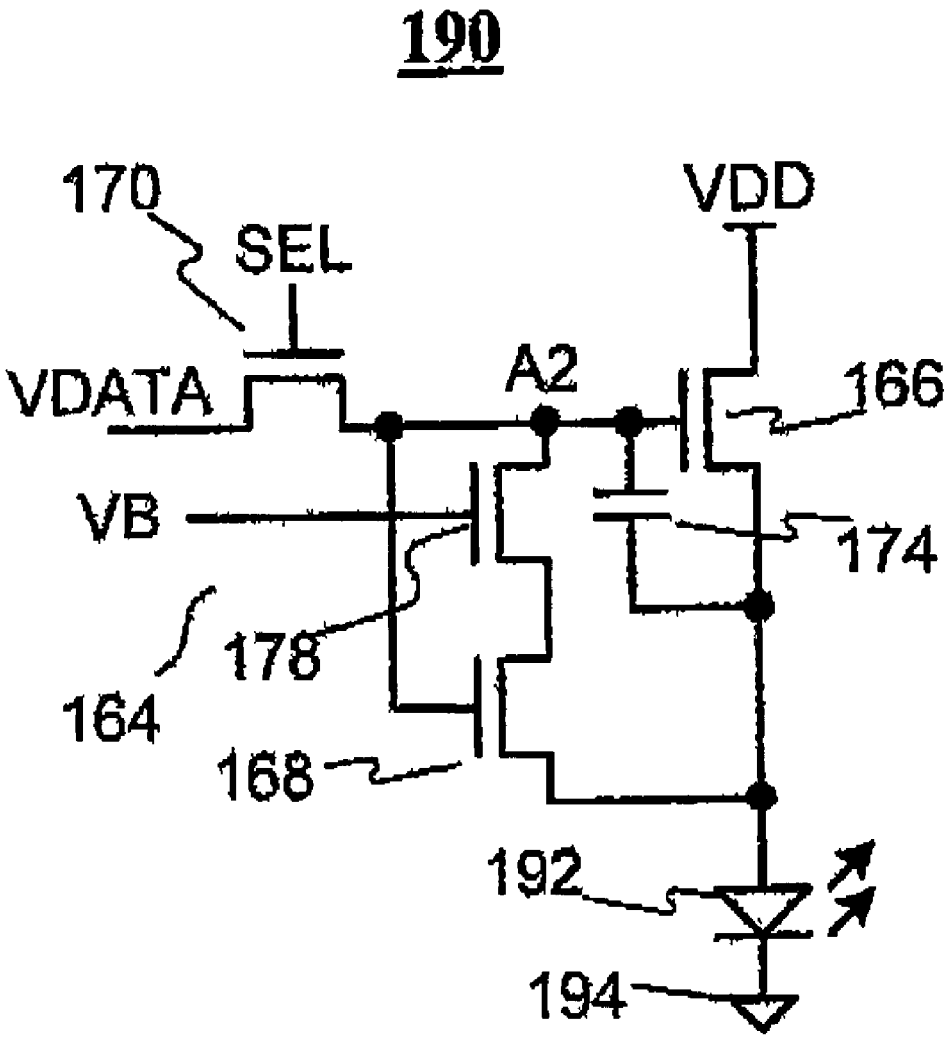
FIG. 8 is a diagram illustrating another example of a pixel circuit having the drive circuit of FIG. 5.

FIG. 8 illustrates another example of a pixel circuit having the drive circuit 164 of FIG. 5. The pixel circuit 190 is similar to the pixel circuit 160 of FIG. 5. The pixel circuit 190 includes an OLED 192. The OLED 192 may be same or similar to the OLED 162 of FIG. 5. In the pixel circuit 190, the drive transistor 166 is provided between one electrode (e.g., anode electrode) of the OLED 192 and VDD. One terminal of the discharging transistor 168 and one terminal of the storage capacitor 174 are connected to the OLED 192. The other electrode (e.g., cathode electrode) of the OLED 192 is connected to a power supply line (e.g., common ground) 194.

In one example, the bias voltage VB of FIG. 8 is shared between the pixels of the entire panel. In another example, the bias voltage VB of FIG. 8 is connected to node A2, as it is similar to that of FIG. 6. In a further example, the switch transistor 172 of FIG. 8 is replaced with a resistor, as it is similar to that of FIG. 7.

The pixel circuit 190 provides constant averaged current over the frame time, in a manner similar to that of the pixel circuit 160 of FIG. 5.

Figure 9:
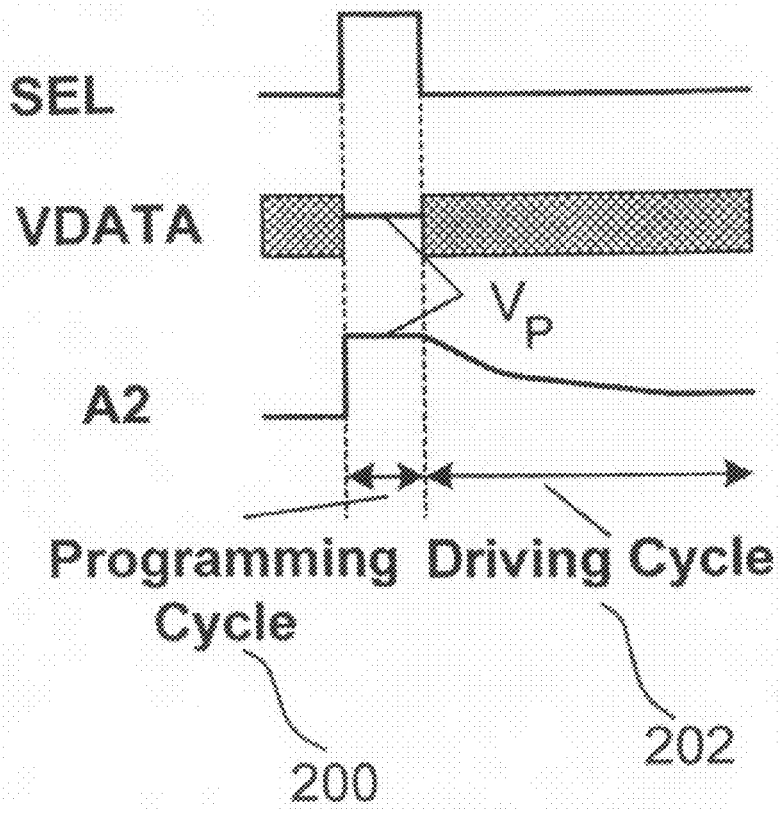
FIG. 9 is a timing diagram for an example of a method of driving a pixel circuit in accordance with another embodiment of the present invention.

FIG. 9 illustrates an example of method of driving a pixel circuit in accordance with another embodiment of the present invention. The waveforms of FIG. 9 are applied to a pixel circuit (e.g., 160 of FIG. 5, 190 of FIG. 8) having the drive circuit 164 of FIGS. 5 and 8.

The operation cycle of FIG. 9 includes a programming cycle 200 and a driving cycle 202. Referring to FIGS. 5, 8 and 9, during the programming cycle 200, node A2 is charged to a programming voltage (Vp) through the switch transistor 170 while SEL is high. During the driving cycle 202, node A2 is discharged through the discharging transistor 168. Since the drive transistor 166 and the discharging transistor 168 have the same bias condition, they experience the same threshold voltage shift. Considering that the discharge time is a function of transconductance of the discharging transistor 168, the discharge time increases as the threshold voltage of the drive transistor 166/the discharging transistor 168 increases. Therefore, the average current of the pixel (160 of FIG. 5, 190 of FIG. 8) over the frame time remains constant. Here, the switch transistor 172 forces the discharging transistor 168 in the linear regime of operation, and so reduces feedback gain. Therefore, the discharging transistor 168 may be a unity transistor with the minimum channel length and width. The width and length of the unity transistor are the minimum allowed by the technology.

In addition, in the pixel circuit 190 of FIG. 8, an increase in the OLED voltage for the OLED 192 results in longer discharge time. Thus, the averaged pixel current will remain constant even after the OLED degradation.

Figure 10:
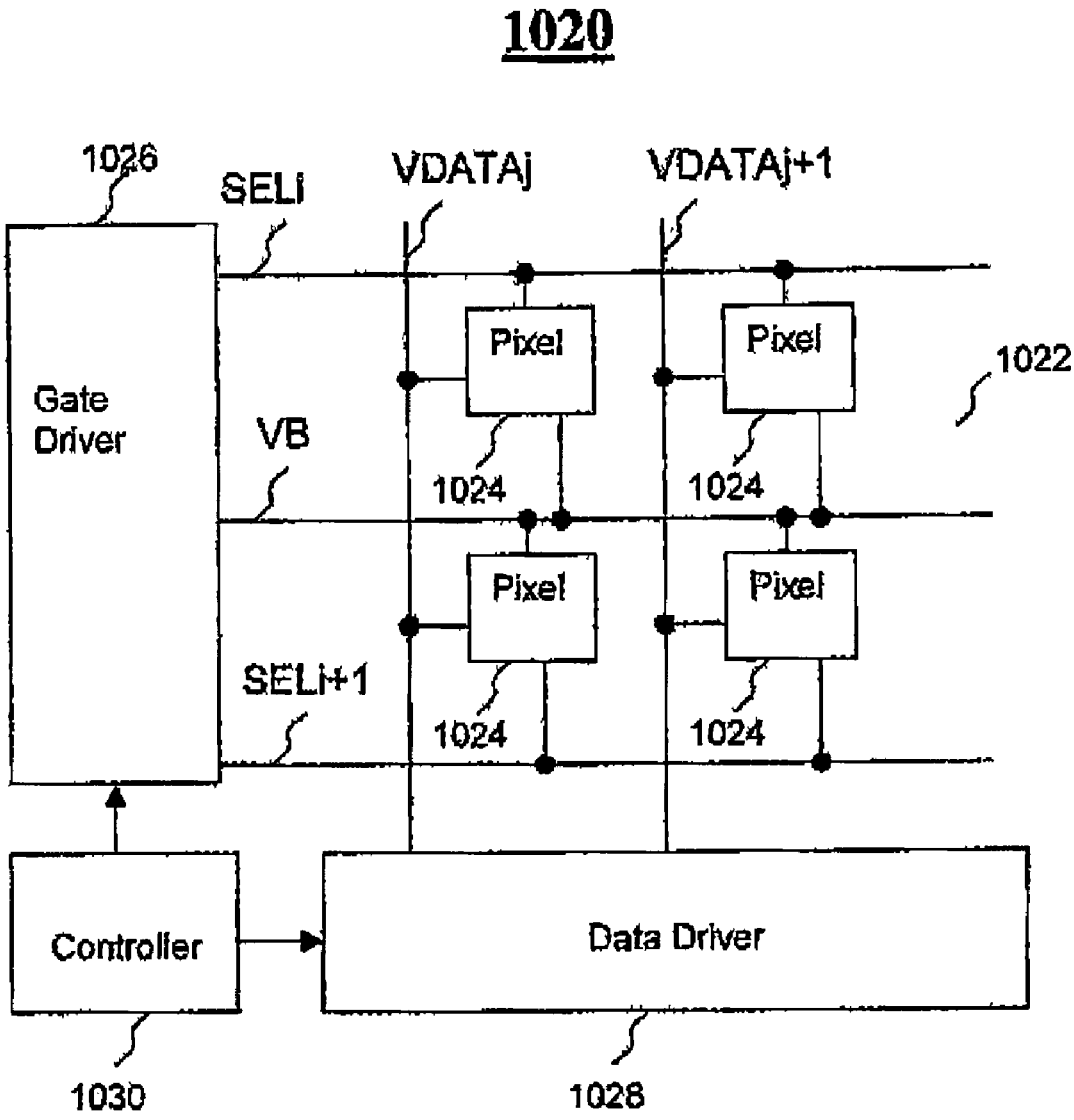
FIG. 10 is a diagram illustrating au example of a display system for the drive circuit of FIGS. 5 and 8.

FIG. 10 illustrates an example of a display system for the drive circuit of FIGS. 5 and 8. The display system 1020 of FIG. 10 includes a display array 1022 having a plurality of pixels 1024. The pixel 1024 includes the drive circuit 164 of FIGS. 5 and 8, and may be the pixel circuit 130 of FIG. 5 or the pixel circuit 190 of FIG. 8.

The display array 1022 is an active matrix light emitting display. In one example, the display array 1022 is an AMOLED display array. The display array 1022 may be a single color, multi-color or a fully color display, and may include one or more than one EL element (e.g., organic EL). The display array 1022 may be used in mobiles, PDAs, computer displays, or cellular phones.

Each of select lines SELi and SELi+1 corresponds to SEL of FIGS. 5 and 8. VB corresponds to VB of FIGS. 5 and 8. Each of data lines VDATAj and VDATAj+1 corresponds to VDATA of FIGS. 5 and 8. The pixels 1024 are arranged in rows and columns. The select line (SELi, SELi+1) is shared between common row pixels in the display array 1022. The data line (VDATAj, VDATAj+1) is shared between common column pixels in the display array 1022. The bias voltage line VB is shared by the ith and (i+1)th rows. In another example, the VB may be shared by the entire array 1022.

In FIG. 10, four pixels 1024 are shown. However, the number of the pixels 1024 may vary in dependence upon the system design, and does not limited to four. In FIG. 10, two select lines and two data lines are shown. However, the number of the select lines and the data lines may vary in dependence upon the system design, and does not limited to two.

A gate driver 1026 drives SELi and SELi+1, and VB. The gate driver 1026 may include an address driver for providing address signals to the display array 1022. A data driver 1028 generates a programming data and drives VDATAj and VDATAj+1. A controller 1030 controls the drivers 1026 and 1028 to drive the pixels 1024 as described above.

Figure 6:
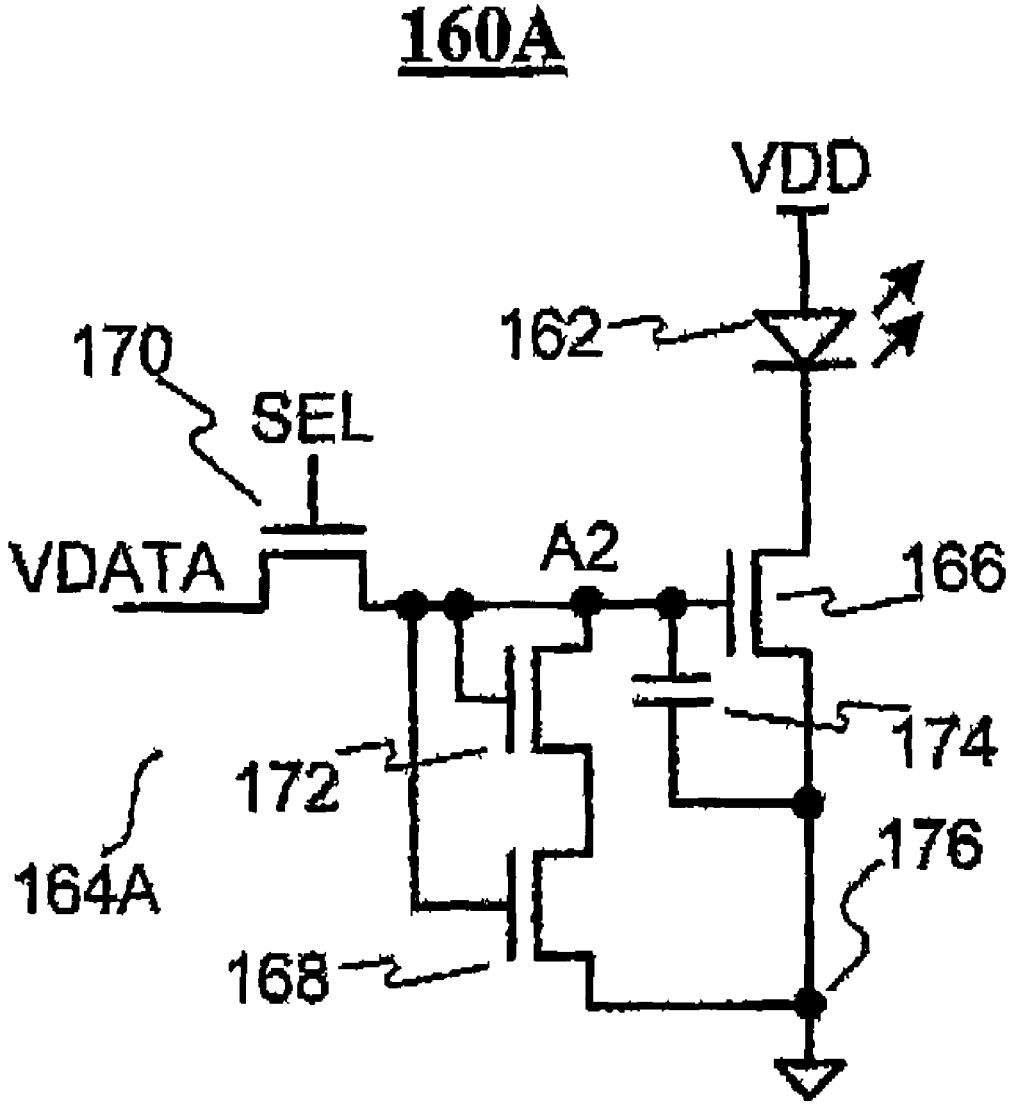
FIG. 6 is a diagram illustrating another example of a drive circuit of FIG. 5.
Figure 7:
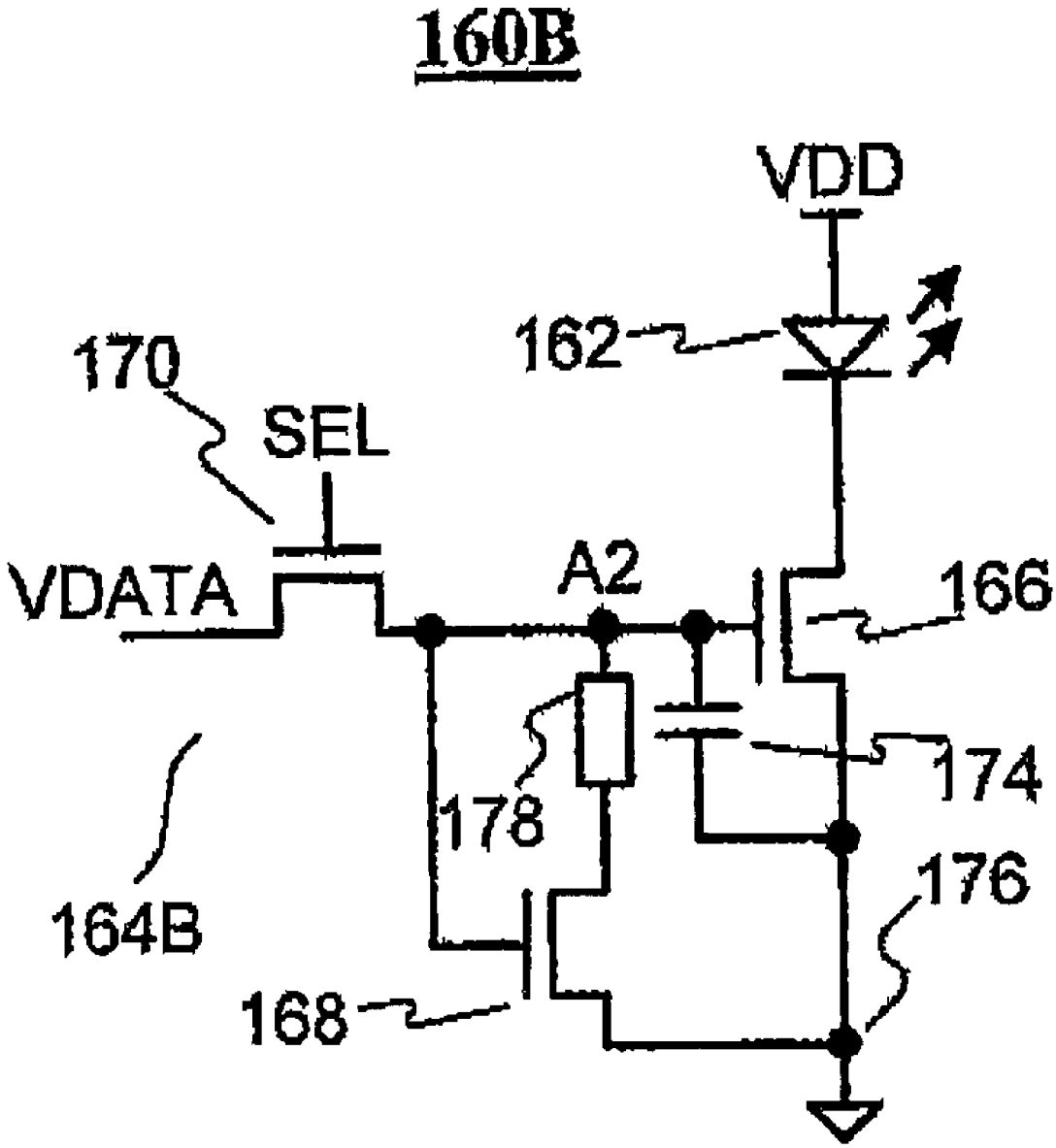
FIG. 7 is a diagram illustrating a Her example of the drive circuit of FIG. 5.
Figure 11:
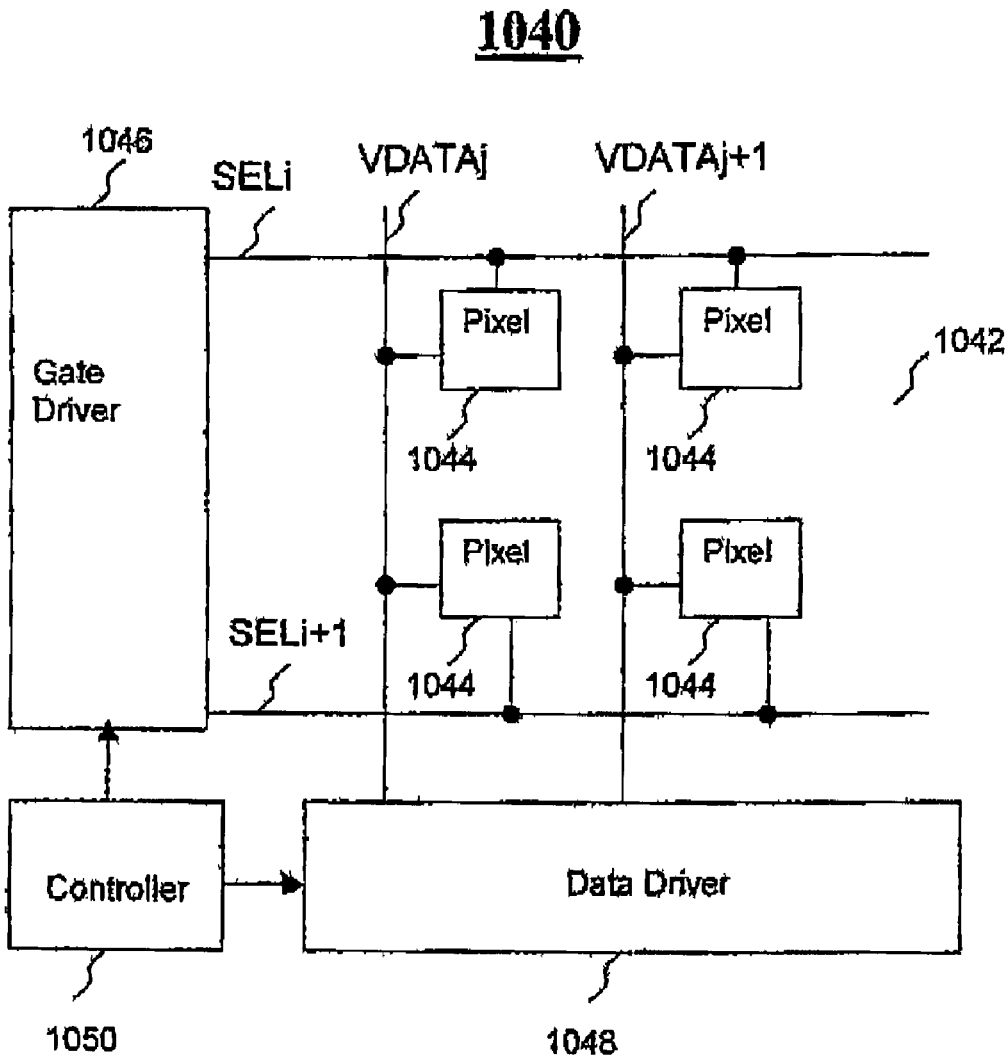
FIG. 11 is a diagram illustrating an example of a display system for the drive circuit of FIGS. 6 and 7.

FIG. 11 illustrates an example of a display system for the drive circuit of FIGS. 6 and 7. The display system 1040 of FIG. 11 includes a display array 1042 having a plurality of pixels 1044. The pixel 1044 includes the drive circuit 164A of FIG. 6 or 164B of FIG. 7, and may be the pixel circuit 160A of FIG. 6 or the pixel circuit 160B of FIG. 7.

The display array 1042 is an active matrix light emitting display. In one example, the display array 1042 is an AMOLED display array. The display array 1042 may be a single color, multi-color or a fully color display, and may include one or more than one EL element (e.g., organic EL). The display array 1042 may be used in mobiles, PDAs, computer displays, or cellular phones.

Each of select lines SELi and SELi+1 corresponds to SEL of FIGS. 6 and 7. Each of data lines VDATAj and VDATAj+1 corresponds to VDATA of FIGS. 6 and 7. The pixels 1044 are arranged in rows and columns. The select line (SELi, SELi+1) is shared between common row pixels in the display array 1042. The data line (VDATAj, VDATAj+1) is shared between common column pixels in the display array 1042.

In FIG. 11, four pixels 1044 are shown. However, the number of the pixels 1044 may vary in dependence upon the system design, and does not limited to four. In FIG. 11, two select lines and two data lines are shown. However, the number of the select lines and the data lines may vary in dependence upon the system design, and does not limited to two.

A gate driver 1046 drives SELi and SELi+1. The gate driver 1046 may be an address driver for providing address signals to the address lines (e.g., select lines). A data driver 1048 generates a programming data and drives VDATAj and VDATAj+1. A controller 1040 controls the drivers 1046 and 1048 to drive the pixels 1044 as described above.

Figure 12:
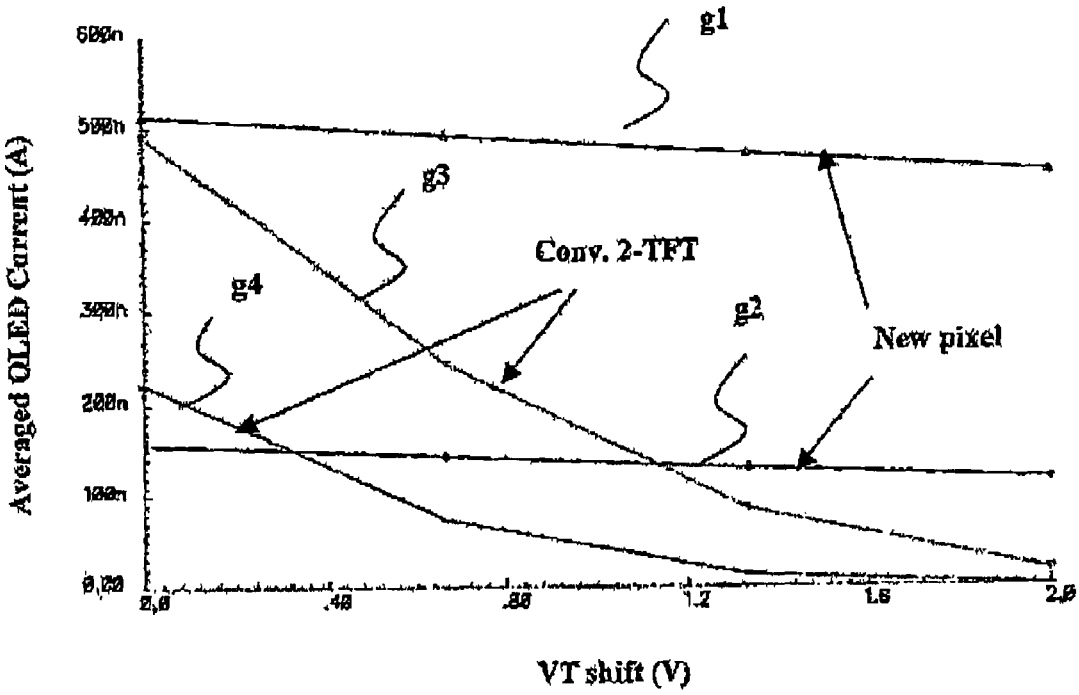
FIG. 12 is a graph illustrating simulation results for the pixel circuit of FIG. 1.

FIG. 12 illustrates simulation results for the pixel circuit 100 of FIG. 1. In FIG. 12, "g1" represents the current of the pixel circuit 100 presented in FIG. 1 for different shifts in the threshold voltage of the drive transistor 106 and initial current of 500 nA; "g2" represents the current of the pixel circuit 100 for different shifts in the threshold voltage of the drive transistor 106 and initial current of 150 nA. In FIG. 12, "g3" represents the current of a conventional 2-TFT pixel circuit for different shifts in the threshold voltage of a drive transistor and initial current of 500 dA; "g4" represents the current of the conventional 2-TFT pixel circuit for different shifts in the threshold voltage of a drive transistor and initial current of 150 nA. It is obvious that the averaged pixel current is stable for the new driving scheme whereas it drops dramatically if the discharging transistor (e.g., 106 of FIG. 1) is removed from the pixel circuit (conventional 2-TFT pixel circuit).

Figure 13:
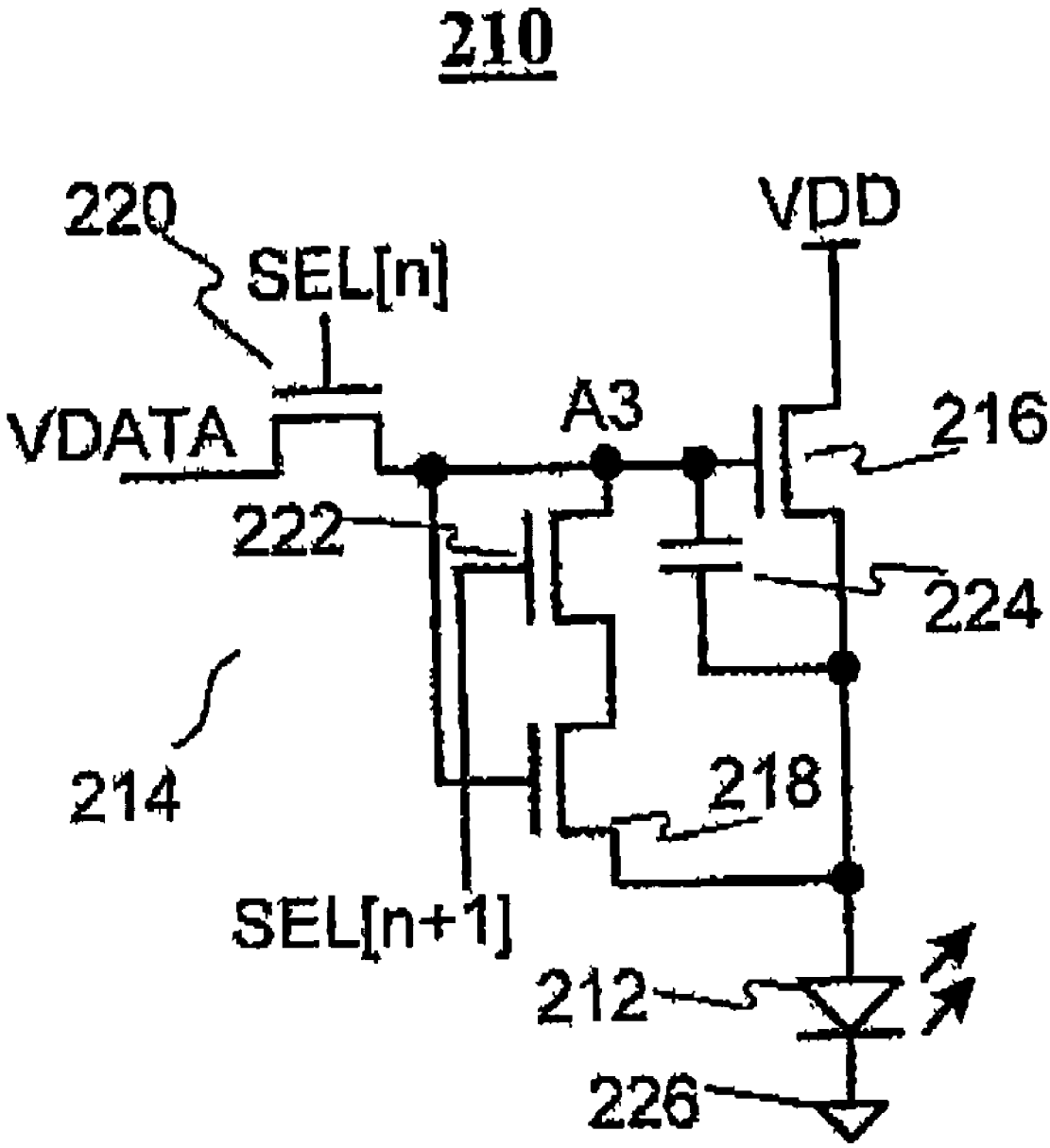
FIG. 13 is a diagram illustrating an example of a pixel circuit to which a pixel drive scheme in accordance with a further embodiment of the present invention is applied.

FIG. 13 illustrates an example of a pixel circuit to which a pixel drive scheme in accordance with a further embodiment of the present invention. The pixel circuit 210 of FIG. 13 includes an OLED 212 and a drive circuit 214 for driving the OLED 212. The drive circuit 214 includes a drive transistor 216, a discharging transistor 218, first and second switch transistors 220 and 222, and a storage capacitor 224.

The pixel circuit 210 is similar to the pixel circuit 190 of FIG. 8. The drive circuit 214 is similar to the drive circuit 164 of FIGS. 5 and 8. The transistors 216, 218 and 220 correspond to the transistors 166, 168 and 170 of FIGS. 5 and 8, respectively. The transistors 216, 218, and 220 may be same or similar to the transistors 166, 168, and 170 of FIGS. 5 and 8. The transistor 222 may be same or similar to the transistor 172 of FIG. 5 or the transistor 178 of FIG. 8. In one example, each of the transistors 216, 218, 220, and 222 includes a gate terminal, a source terminal and a drain terminal. The storage capacitor 224 corresponds to the storage capacitor 174 of FIGS. 5 to 8. The storage capacitor 224 may be same or similar to the storage capacitor 174 of FIGS. 5 to 8. The OLED 212 corresponds to the OLED 192 of FIG. 8. The OLED 212 may be same or similar to the OLED 192 of FIG. 8.

The transistors 216, 218, 220, and 222 may be fabricated using amorphous silicon, nano/micro crystalline silicon, poly silicon, organic semiconductors technologies (e.g., organic TFT), NMOS/PMOS technology or CMOS technology (e.g., MOSFET).

In the pixel circuit 210, the drive transistor 216 is provided between VDD and one electrode (e.g., anode electrode) of the OLED 212. The switch transistor 222 and the discharging transistor 218 are connected in series between the gate terminal of the drive transistor 216 and the OLED 212. One terminal of the switch transistor 222 is connected to the gate terminal of the drive transistor at node A3. The gate terminal of the discharging transistor 218 is connected to node A3. The storage capacitor 224 is provided between node A3 and the OLED 212. The switch transistor 220 is provided between VDATA and node A3. The gate terminal of the switch transistor 220 is connected to a select line SEL[n]. The gate terminal of the switch transistor 222 is connected to a select line SEL [n+1]. The other electrode (e.g., cathode electrode) of the OLED 212 is connected to a power supply line (e.g., common ground) 226. In one example, SEL [n] is the address line of the nth row in a display array, and SEL[n+1] is the address line of the (n+1)th row in the display array.

The pixel circuit 210 provides constant averaged current over the frame time by adjusting the gate voltage of the drive transistor 216, as described below.

Figure 14:
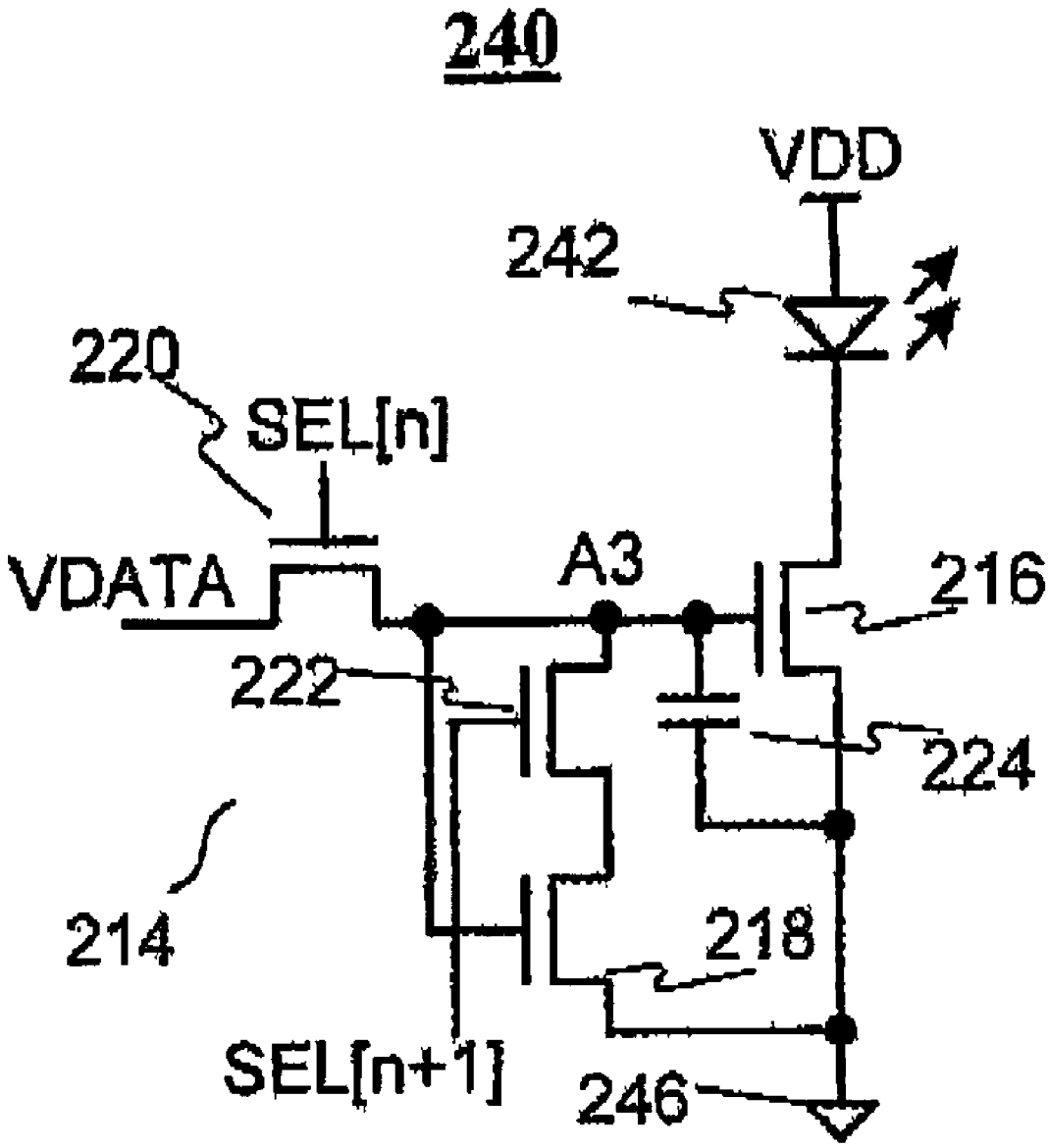
FIG. 14 is a diagram illustrating another example of a pixel circuit having a drive circuit of FIG. 13.

FIG. 14 illustrates another example of a pixel circuit having the drive circuit 214 of FIG. 13. The pixel circuit 240 of FIG. 14 is similar to the pixel circuit 160 of FIG. 5. The pixel circuit 240 includes an OLED 242. The OLED 242 may be same or similar to the OLED 162 of FIG. 5. In the pixel circuit 240, the drive transistor 216 is provided between one electrode (e.g., cathode electrode) of the OLED 242 and a power supply line (e.g., common ground) 246. One terminal of the discharging transistor 218 and one terminal of the storage capacitor 224 are connected to the power supply line 246. The other electrode (e.g., anode electrode) of the OLED 242 is connected to VDD. The gate terminal of the switch transistor 220 is connected to the select line SEL[n]. The gate terminal of the switch transistor 222 is connected to the select line SEL [n+1].

The pixel circuit 240 provides constant averaged current over the frame time, in a manner similar to that of the pixel circuit 210 of FIG. 13.

Figure 15:
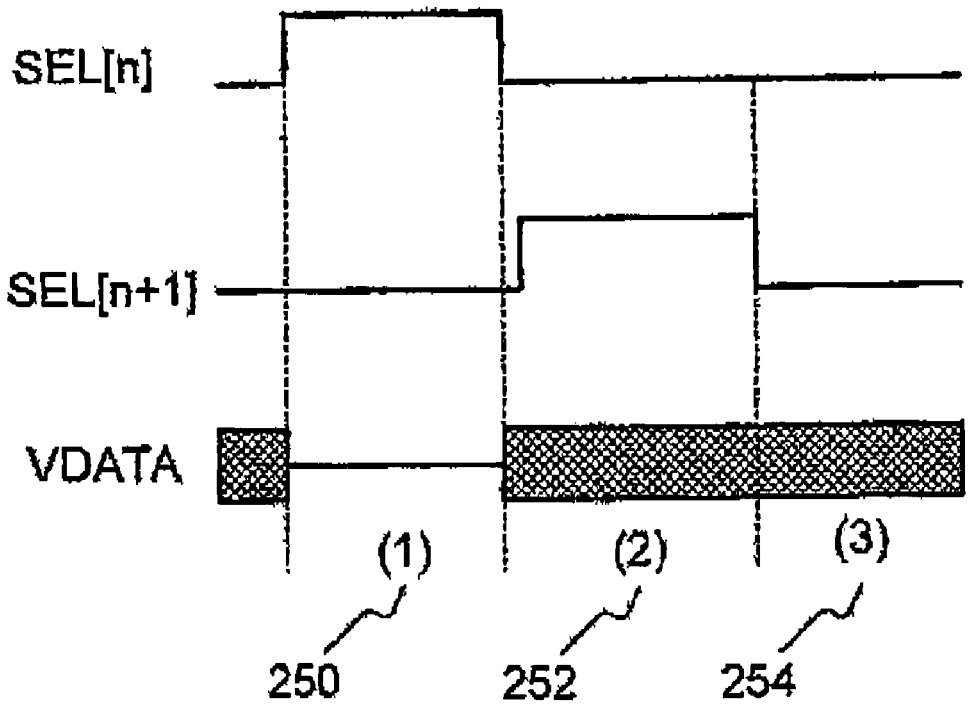
FIG. 15 is a timing diagram for an example of a method of driving a pixel circuit in accordance with a further embodiment of the present invention.

FIG. 15 illustrates an example of method of driving a pixel circuit in accordance with an embodiment of the present invention. The waveforms of FIG. 15 are applied to a pixel circuit (e.g., 210 of FIG. 13, 240 of FIG. 14) having the drive circuit 214 of FIGS. 13 and 14.

The operation cycles of FIG. 15 include three operation cycles 250, 252 and 254. The operation cycle 250 forms a programming cycle, the operation cycle 252 forms a compensation cycle, and the operation cycle 254 forms a driving cycle. Referring to FIGS. 13 to 15, during the programming cycle 250, node A3 is charged to a programming voltage through the switch transistor 220 while SEL[n] is high. During the second operating cycle 252 SEL[n+1] goes to a high voltage. SEL[n] is disenabled (or deactivated). Node A3 is discharged through the discharging transistor 218. During the third operating cycle 254, SEL[n] and SEL[n+1] are disenabled. Since the drive transistor 216 and the discharging transistor 218 have the same bias condition, they experience the same threshold voltage shift. Considering that the discharge time is a function of transconductance of the discharging transistor 218, the discharged voltage decreases as the threshold voltage of the drive transistor 216/the discharging transistor 218 increases. Therefore, the gate voltage of the drive transistor 216 is adjusted accordingly.

In addition, in the pixel 240 of FIG. 14, an increase in the OLED voltage for the OLED 242 results in higher gate voltage. Thus, the pixel current remains constant.

Figure 16:
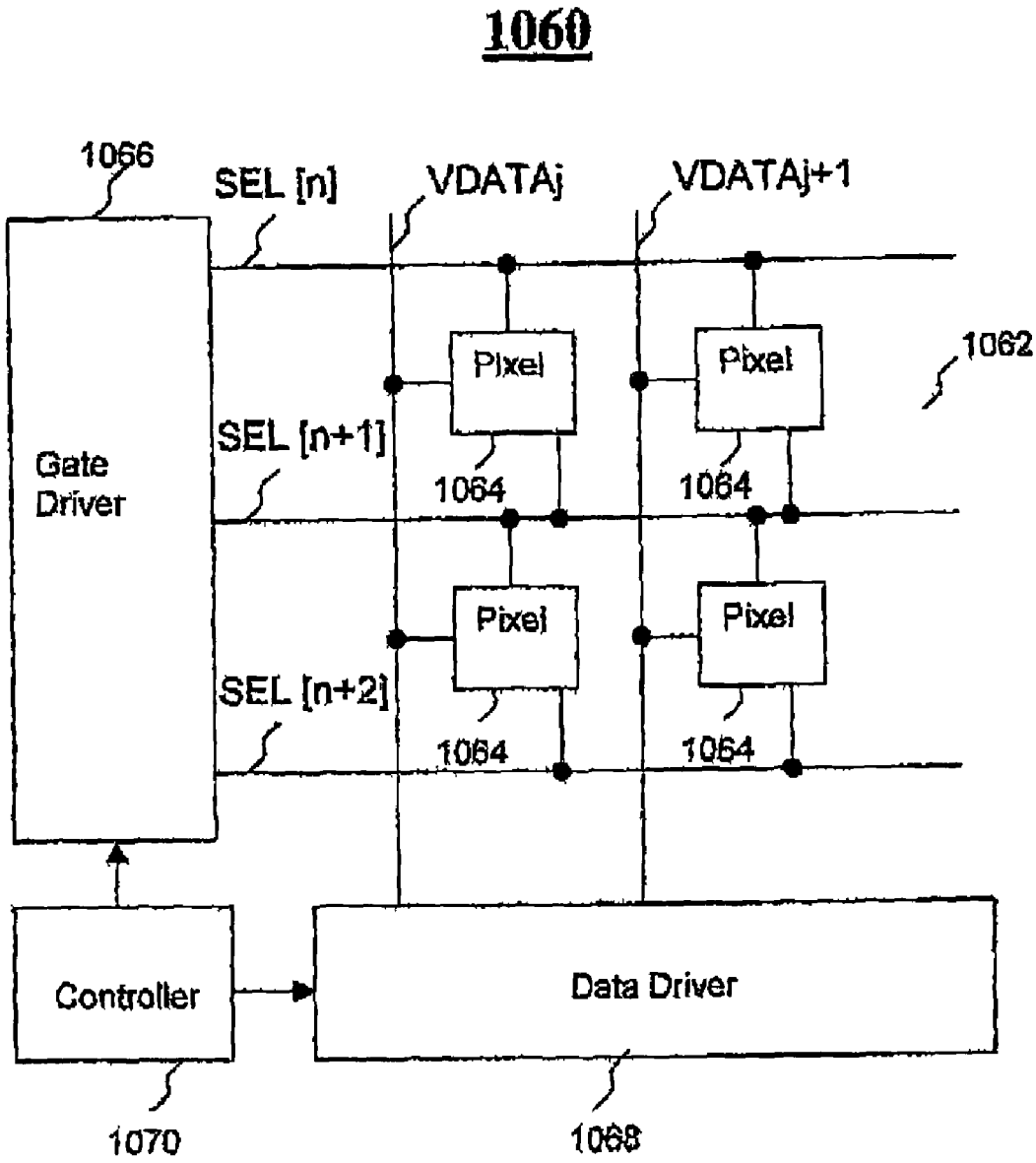
FIG. 16 is a diagram illustrating an example of a display system for the drive circuit of FIGS. 13 and 14.

FIG. 16 illustrates an example of a display system for the drive circuit of FIGS. 13 and 14. The display system 1060 of FIG. 16 includes a display array 1062 having a plurality of pixels 1064. The pixel 1064 includes the drive circuit 214 of FIGS. 13 and 14, and may be the pixel circuit 210 of FIG. 13 or the pixel circuit 240 of FIG. 14.

The display array 1062 is an active matrix light emitting display. In one example, the display array 1062 is an AMOLED display array. The display array 1062 may be a single color, multi-color or a fully color display, and may include one or more than one EL element (e.g., organic EL). The display array 1062 may be used in mobiles, PDAS, computer displays, or cellular phones.

SEL[K] (k=n, n+1, n+2) is an address line for the kth row. VDATAl (l=j, j+1) is a data line and corresponds to VDATA of FIGS. 13 and 14. The pixels 1064 are arranged in rows and columns. The select line SEL[k] is shared between common row pixels in the display array 1062. The data line VDATAl is shared between common column pixels in the display array 1062.

In FIG. 16, four pixels 1064 are shown. However, the number of the pixels 1064 may vary in dependence upon the system design, and does not limited to four. In FIG. 16, three address lines and two data lines are shown. However, the number of the address lines and the data lines may vary in dependence upon the system design.

A gate driver 1066 drives SEL[k]. The gate driver 1066 may be an address driver for providing address signals to the address lines (e.g., select lines). A data driver 1068 generates a programming data and drives VDATAl. A controller 1070 controls the drivers 1066 and 1068 to drive the pixels 1064 as described above.

Figure 17:
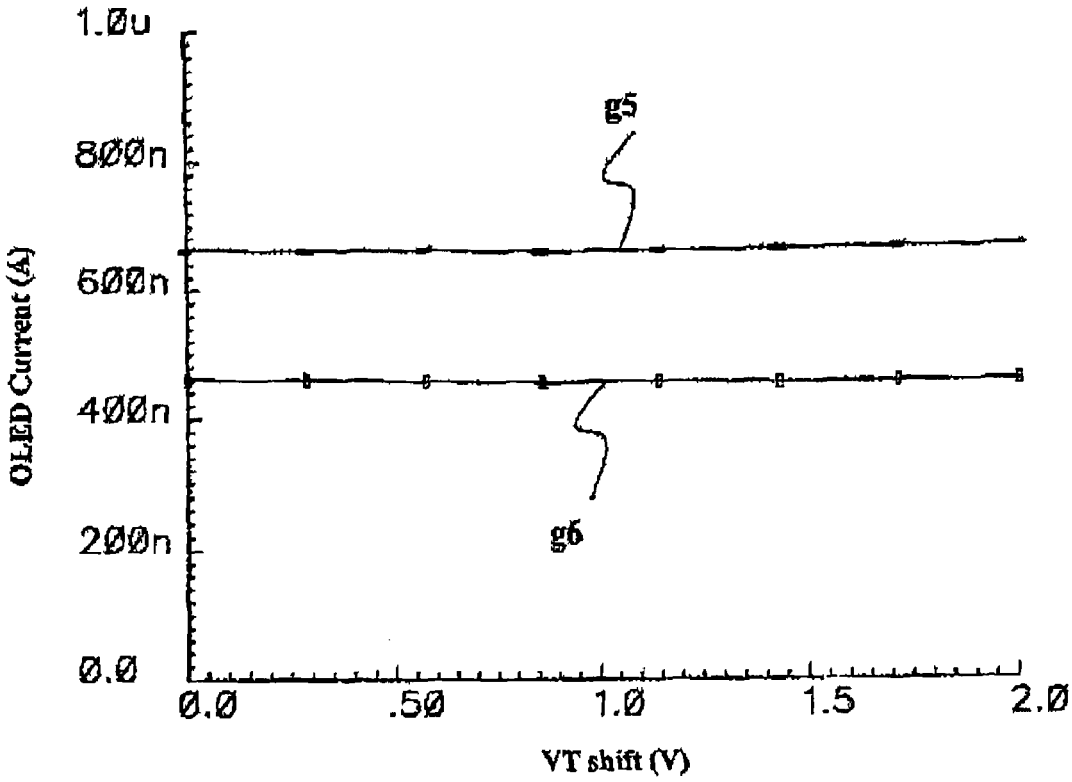
FIG. 17 is a graph illustrating simulation results for the pixel circuit of FIG. 5.

FIG. 17 illustrates the simulation results for the pixel circuit 160 of FIG. 5. In FIG. 17, "g5" represents the current of the pixel circuit 160 presented in FIG. 5 for different shifts in the threshold voltage of the drive transistor 166 and initial current of 630 nA; "g6" represents the current of the pixel circuit 160 for different shifts in the threshold voltage of the drive transistor 166 and initial current of 430 nA. It is seen that the pixel current is highly stable even after a 2-V shift in the threshold voltage of the drive transistor. Since the pixel circuit 210 of FIG. 13 is similar to the pixel circuit 160 of FIG. 15, it is apparent to one of ordinary skill in the art that the pixel current of the pixel circuit 210 will be also stable.

Figure 18:
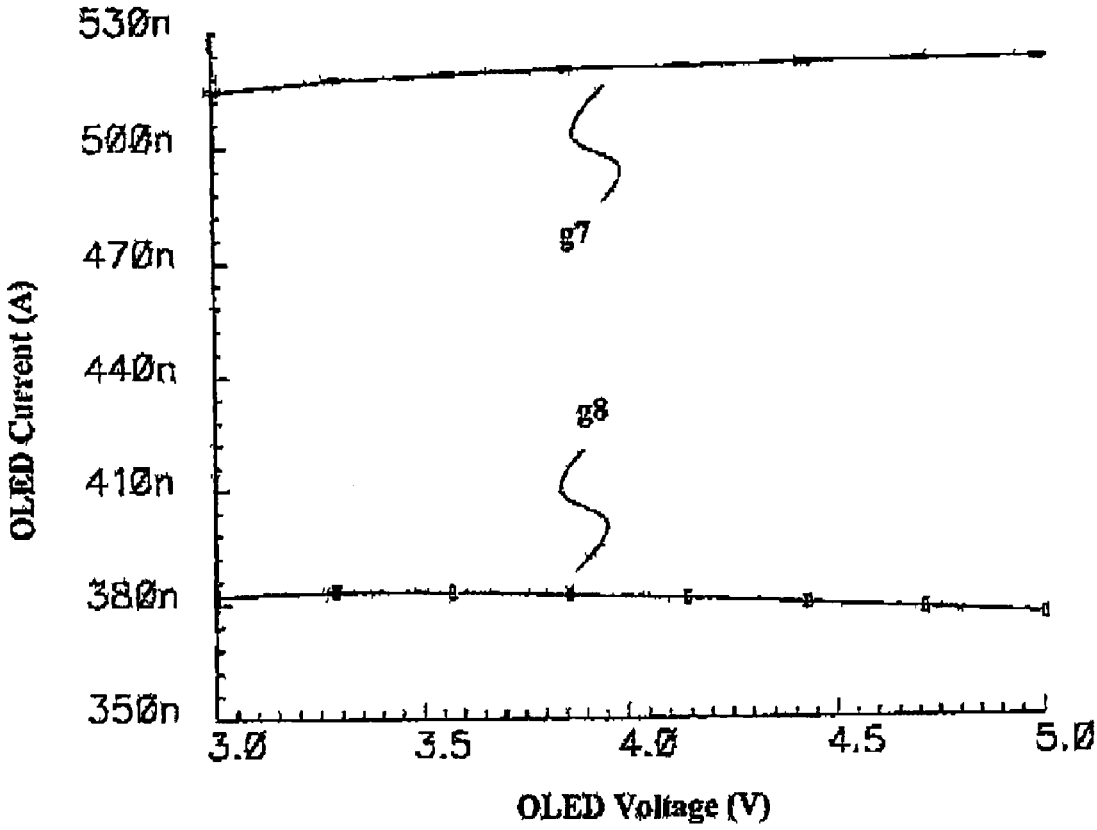
FIG. 18 is a graph illustrating simulation results for the pixel circuit of FIG. 5.

FIG. 18 illustrates the simulation results for the pixel circuit 160 of FIG. 5. In FIG. 18, "g7" represents the current of the pixel circuit 160 presented in FIG. 5 for different OLED voltages of the drive transistor 166 and initial current of 515 nA; "g8" represents the current of the pixel circuit 160 for different OLED voltages of the drive transistor 166 and initial current of 380 nA. It is seen that the pixel current is highly stable even after a 2-V shift in the voltage of the OLED. Since the pixel circuit 210 of FIG. 13 is similar to the pixel circuit 160 of FIG. 15, it is apparent to one of ordinary skill in the art that the pixel current of the pixel circuit 210 will be also stable.

Figure 19:
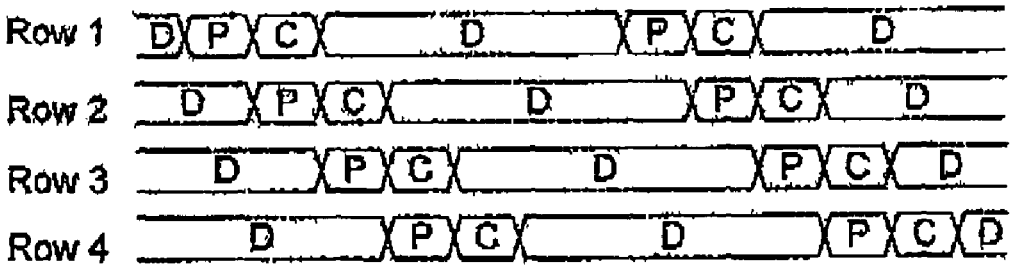
FIG. 19 is a timing diagram for the operation of the display system of FIG. 16.

FIG. 19 is a diagram showing programming and driving cycles for driving the display arrays 1062 of FIG. 16. In FIG. 16, each of ROW j (j=1, 2, 3, 4) represents the jth row of the display array 1062. In FIG. 19, "P" represents a programming cycle; "C" represents a compensation cycle; and "D" represents a driving cycle. The programming cycle P at the jth Row overlaps with the driving cycle D at the (j+1)th Row. The compensation cycle C at the jth Row overlaps with the programming cycle P at the (j+1)th Row. The driving cycle D at the jth Row overlaps with the compensation cycle C at the (j+1)th Row.

Figure 20:
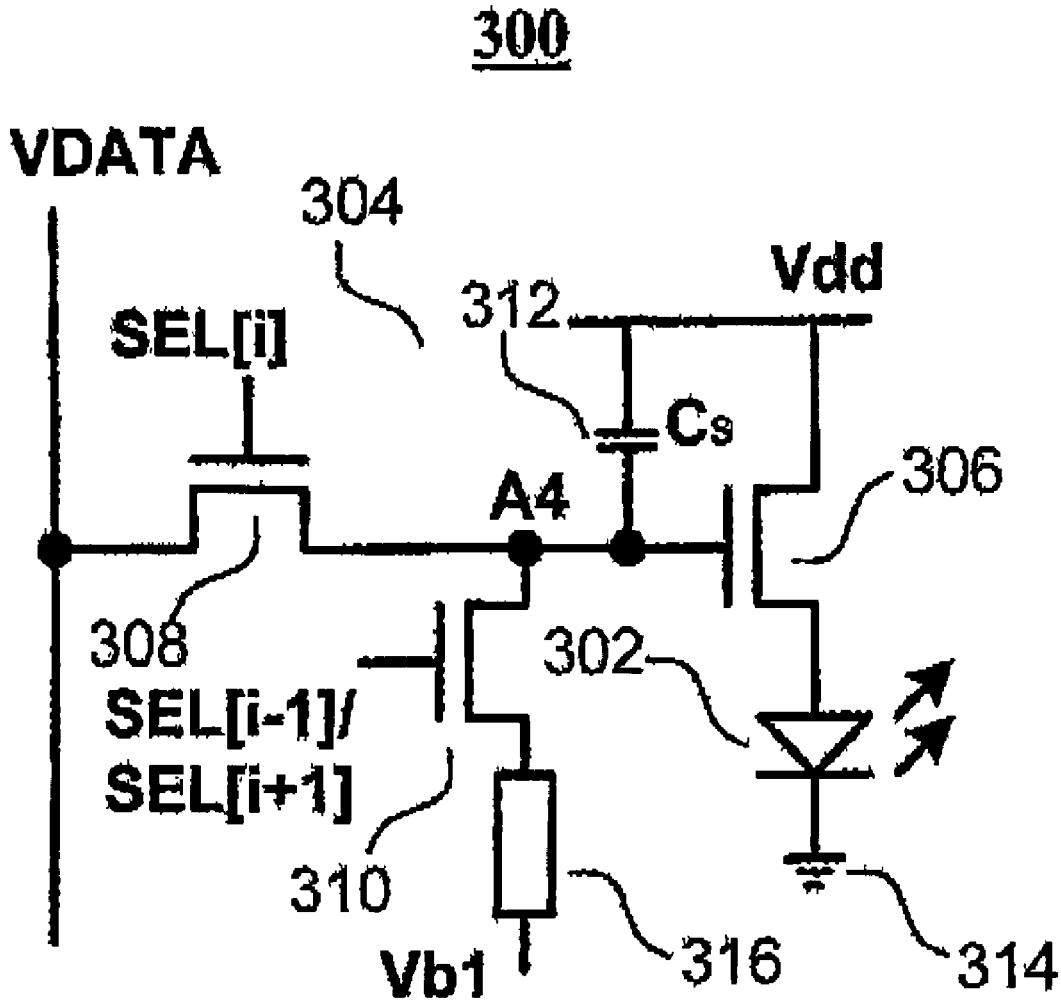
FIG. 20 is a diagram illustrating an example of a pixel circuit to which a pixel drive scheme in accordance with a further embodiment of the present invention is applied.

FIG. 20 illustrates an example of a pixel circuit to which a pixel drive scheme in accordance with a further embodiment of the present invention is applied. The pixel circuit 300 of FIG. 20 includes an OLED 302 and a drive circuit 304 for driving the OLED 302. The drive circuit 304 includes a drive transistor 306, a switch transistor 308, a discharging transistor 310, and a storage capacitor 312. The OLED 302 includes, for example, an anode electrode, a cathode electrode and an emission layer between the anode electrode and the cathode electrode.

In one example, the transistors 306, 308 and 310 are n-type transistors. In another example, the transistors 306, 308 and 310 are p-type transistors or a combination of n-type and p-type transistors. In one example, each of the transistors 306, 308 and 310 includes a gate terminal, a source ter and a drain terminal. The transistors 306, 308 and 310 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 306 is provided between a voltage supply line Vdd and the OLED 302. One terminal (e.g., source) of the drive transistor 306 is connected to Vdd. The other terminal (e.g., drain) of the drive transistor 306 is connected to one electrode (e.g., anode electrode) of the OLED 302. The other electrode (e.g., cathode electrode) of the OLED 302 is connected to a power supply line (e.g., common ground) 314. One terminal of the storage capacitor 312 is connected to the gate terminal of the drive transistor 306 at node A4. The other terminal of the storage capacitor 312 is connected to Vdd. The gate terminal of the switch transistor 308 is connected to a select line SEL [i]. One terminal of the switch transistor 308 is connected to a data line VDATA. The other terminal of the switch transistor 308 is connected to node A4. The gate terminal of the discharging transistor 310 is connected to a select line SEL [i−1] or SEL[i+1]. In one example, the select line SEL[M] (m=i−1, i, i+1) is an address line for the mth row in a display array. One terminal of the discharging transistor 310 is connected to node A4. The other terminal of the discharging transistor 310 is connected to a sensor 316. In one example, each pixel includes the sensor 316. In another example, the sensor 316 is shared by a plurality of pixel circuits.

The sensor 316 includes a sensing terminal and a bias terminal Vb1. The sensing terminal of the sensor 316 is connected to the discharging transistor 310. The bias terminal Vb1 may be connected, for example, but not limited to, ground, Vdd or the one terminal (e.g., source) of the drive transistor 306. The sensor 316 detects energy transfer from the pixel circuit. The sensor 316 has a conductance that varies in dependence upon the sensing result. The emitted light or thermal energy by the pixel absorbed by the sensor 316 and so the carrier density of the sensor changes. The sensor 316 provides feedback by, for example, but not limited to, optical, thermal or other means of transduction. The sensor 316 may be, but not limited to, an optical sensor or a thermal sensor. As described below, node A4 is discharged in dependence upon the conductance of the sensor 316.

The drive circuit 304 is used to implement programming, compensating/calibrating and driving of the pixel circuit. The pixel circuit 300 provides cost luminance over the lifetime of its display by adjusting the gate voltage of the drive transistor 306.

Figure 21:
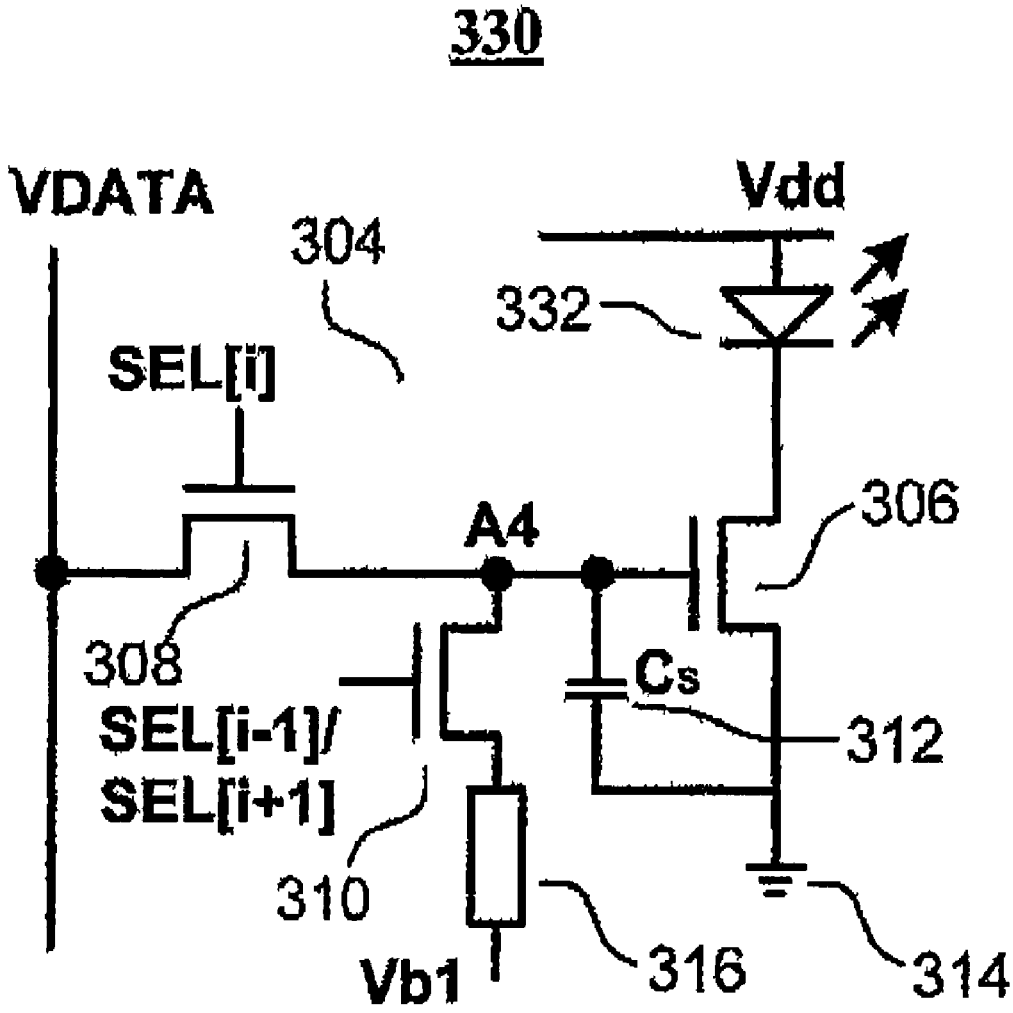
FIG. 21 is a diagram illustrating anther example of a pixel circuit having the drive circuit of FIG. 20.

FIG. 21 illustrates anther example of a pixel circuit having the drive circuit 304 of FIG. 20. The pixel circuit 330 of FIG. 21 is similar to the pixel circuit 300 of FIG. 20. The pixel circuit 330 includes an OLED 332. The OLED 332 may be same or similar to the OLED 302 of FIG. 20. In the pixel circuit 330, one terminal (e.g., drain) of the drive transistor 306 is connected to one electrode (e.g., cathode electrode) of the OLED 332, and the other terminal (e.g., source) of the drive transistor 306 is connected to a power supply line (e.g., common ground) 334. In addition, one terminal of the storage capacitor 312 is connected to node A4, and the other terminal of the storage capacitor 312 is connected to the power supply line 334. The pixel circuit 330 provides constant lace over the lifetime of its display, in a manner similar to that of the pixel circuit 300 of FIG. 20.

Referring to FIGS. 20 and 21, the aging of the drive transistor 306 and the OLED 302/332 in the pixel circuit are compensated in two different ways: in-pixel compensation and of-panel calibration.

Figure 22:
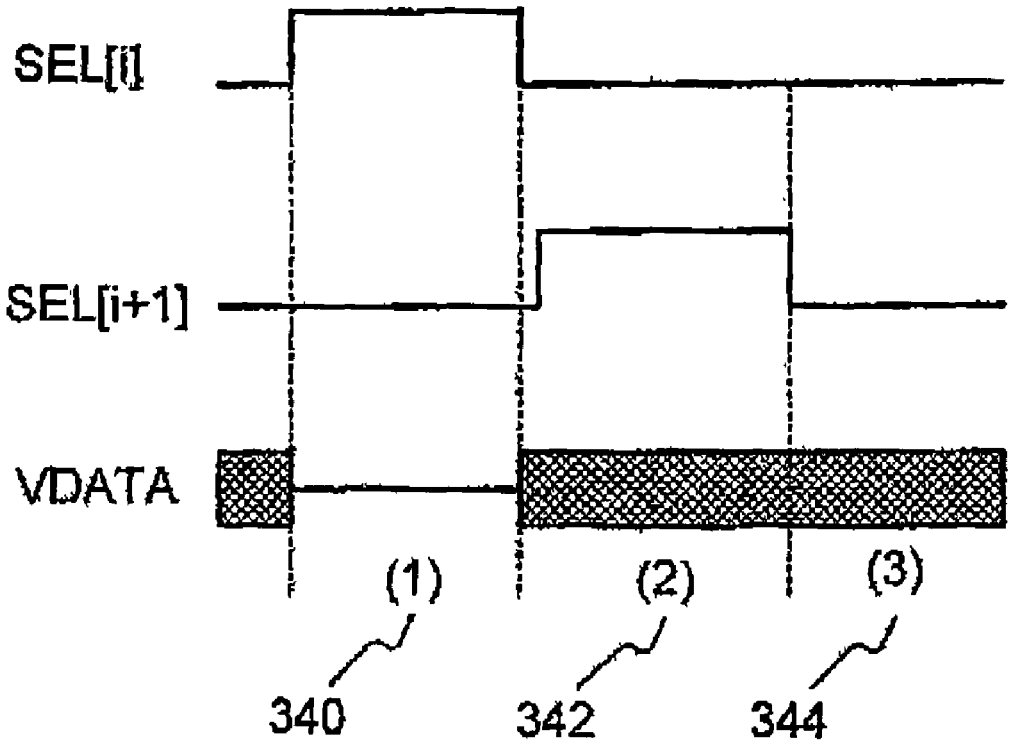
FIG. 22 is a timing diagram illustrating an example of a method of driving a pixel circuit in accordance with a further embodiment of the present invention.

In-pixel compensation is descried in detail. FIG. 22 illustrates an example of a method of driving a pixel circuit in accordance with a further embodiment of the present invention. By applying the waveforms of FIG. 22 to a pixel having the drive circuit 304 of FIGS. 20 and 21, the in-pixel compensation is implemented.

The operation cycles of FIG. 22 include three operation cycles 340, 342 and 344. The operation cycle 340 is a programming cycle of the ith row and is a driving cycle for the (i+1)th row. The operation cycle 342 is a compensation cycle for the ith row and is a programming cycle of the (i+1)th row. The operation cycle 344 is a driving cycle for the ith row and is a compensation cycle for the (i+1)th row.] Referring to FIGS. 20 to 22, during the programming cycle 340 for the it row of a display, node A4 of the pixel circuit in the it row is charged to a programming voltage through the switch transistor 308 while the select line SEL[i] is high. During the programming cycle 342 for the (i+1)th row, SEL[i+1] goes high, and the voltage stored at node A4 changes based on the conductance of the sensor 316. During the driving cycle 344 of the ith row, the current of the drive transistor 306 controls the OLED luminance.

The amount of the discharged voltage at node A4 depends on the conductance of the sensor 316. The sensor 316 is controlled by the OLED luminance or temperature. Thus, the amount of the discharged voltage reduces as the pixel ages. This results in constant luminance over the lifetime of the pixel circuit.

Figure 23:
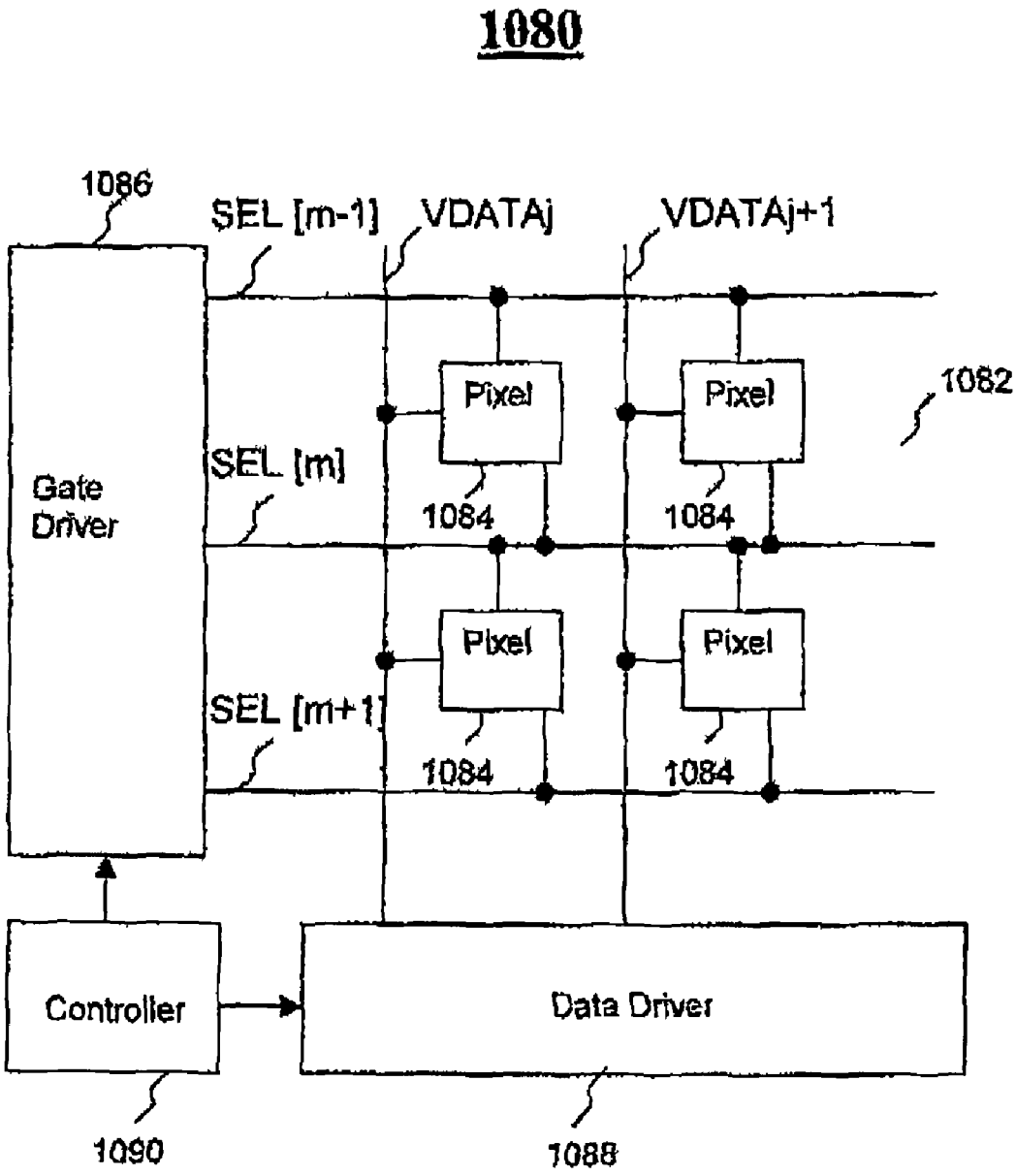
FIG. 23 is a diagram illustrating an example of a display system for the drive circuit of FIGS. 20 and 21.

FIG. 23 illustrates an example of a display system for the drive circuit 304 of FIGS. 20 and 21. The display system 1080 of FIG. 23 includes a display array 1082 having a plurality of pixels 1084. The pixel 1084 includes the drive circuit 304 of FIGS. 20 and 21, and may be the pixel circuit 300 of FIG. 20 or the pixel circuit 330 of FIG. 21.

The display array 1082 is an active matrix light emitting display. In one example, the display array 1082 is an AMOLED display array. The display array 1082 may be a single color, multi-color or a fully color display, and may include one or more than one electroluminescence (EL) element (e.g., organic EL). The display array 1082 may be used in mobiles, personal digital assistants (PDAs), computer displays, or cellular phones.

SEL[i] (i=m−1, m, m+1) in FIG. 23 is an address line for the ith row. VDATAn (n=j, j+1) in FIG. 23 is a data line for the nth column. The address line SEL[i] correspond to the select line SEL[i] of FIGS. 20 and 21. The data line VDATAn corresponds to VDATA of FIGS. 20 and 21.

A gate driver 1086 includes an address driver for providing an address signal to each address line to drive them. A data driver 1088 generates a programming data and drives the data line. A controller 1090 controls the drivers 1086 and 1088 to drive the pixels 1084 and implement the in-pixel compensation as described above.

In FIG. 23, four pixels 1084 are shown. However, the number of the pixels 1084 may vary in dependence upon the system design, and does not limited to four. In FIG. 23, three address lines and two data lines are shown. However, the number of the select lines and the data lines may vary in dependence upon the system design.

In FIG. 23, each of the pixels 1084 includes the sensor 316 of FIGS. 20 and 21. In another example, the display array 1080 may include one or more than one reference pixel having the sensor 316, as shown in FIG. 24.

Figure 24:
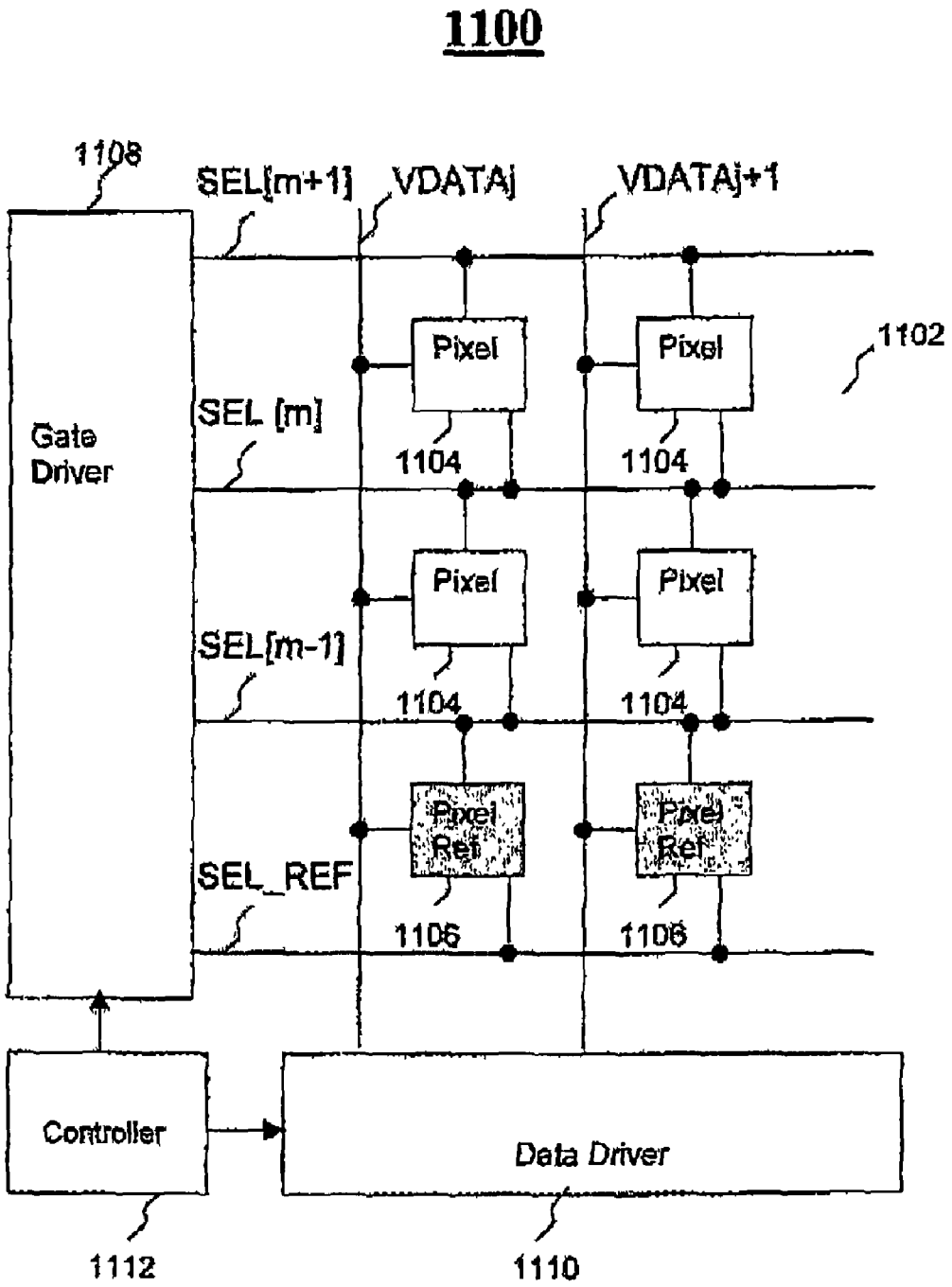
FIG. 24 is a diagram illustrating another example of a display system for the drive circuit of FIGS. 20 and 21.

FIG. 24 illustrates another example of a display system for the drive circuit 304 of FIGS. 20 and 21. The display system 1100 of FIG. 24 includes a display array 1102 having a plurality of pixels 1104 and one or more than one reference pixels 1106. The reference pixel 1106 includes the drive circuit 304 of FIGS. 20 and 21, and may be the pixel circuit 300 of FIG. 20 or the pixel circuit 330 of FIG. 21. In FIG. 24, two reference pixels 1106 are shown. However, the number of the pixels 1084 may vary in dependence upon the system design, and does not limited to two. The pixel 1104 includes an OLED and a drive transistor for driving the OLED, and does not include the sensor 316 of FIGS. 20 and 21. SEL_REF is a select line for selecting the discharging transistors in the array of the reference pixels 1106.

A gate driver 1108 drives the address lines and the select line SEL_REF. The gate driver 1108 may be same or similar to the gate driver 1108 of FIG. 24. A data driver 1110 drives the data lines. The data driver 1110 may be same or similar to the data driver 1088 of FIG. 23. A controller 1112 controls the drivers 1108 and 1110.

The reference pixels of FIGS. 23 and 24 (1084 of FIG. 23, 1106 of FIG. 24) may be operated to provide aging knowledge for an of-panel algorithm in which the programming voltage is calibrated at the controller (1090 of FIG. 23, 1112 of FIG. 24) or driver side (1088 of FIG. 23, 1110 of FIG. 24) as described below.

Of-panel calibration is descried in detail. Referring to FIG. 21, the of-panel calibration is implemented by extracting the aging of the pixel circuit by reading back the sensor 316, and calibrating the programming voltage. The of-panel calibration compensates for the pixel aging including the threshold Vt shift and OLED degradation.

Figure 25:
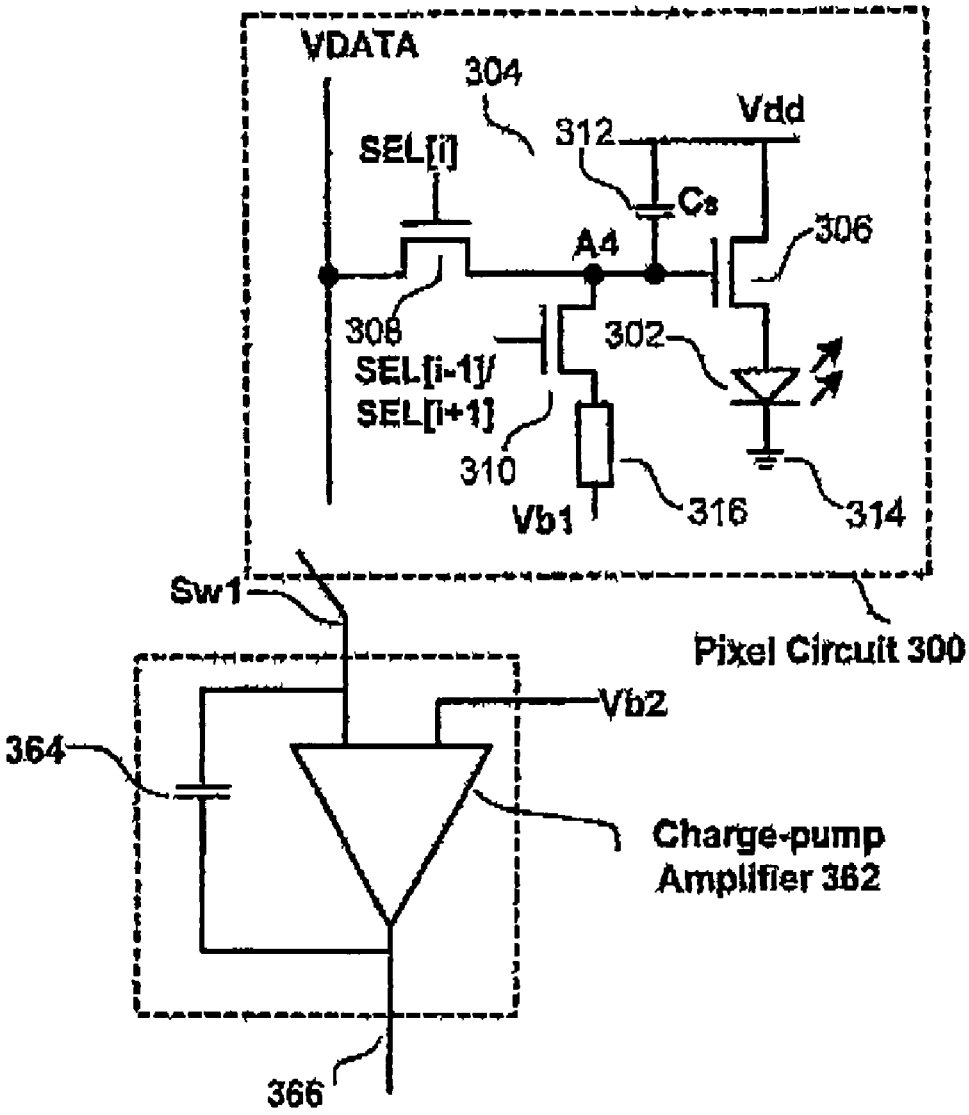
FIG. 25 is a diagram illustrating an example of a pixel system in accordance with an embodiment of the present invention.

FIG. 25 illustrates an example of a pixel system in accordance with an embodiment of the present invention. The pixel system of FIG. 25 includes a read back circuit 360. The read back circuit 360 includes a charge-pump amplifier 362 and a capacitor 364. One teal of the charge-pump amplifier 362 is connectable to the data line VDATA via a switch SW1. The other terminal of the charge-pump amplifier 362 is connected to a bias voltage Vb2. The charge-pump amplifier 362 reads back the voltage discharged from the node A4 via the switch SW1.

The output 366 of the charge pump amplifier 362 varies in dependent upon the voltage at node A4. The time depending characteristics of the pixel circuit is readable from node A4 via the charge-pump amplifier 362.

In FIG. 25, one read back circuit 360 and one switch SW1 are illustrated for one pixel circuit. However, the read back circuit 360 and the switch SW1 may be provided for a group of pixel circuits (e.g., pixel circuits in a column). In FIG. 25, the read back circuit 360 and the switch SW1 are provided to the pixel circuit 300. In another example, the read back circuit 360 and the switch SW1 are applied to the pixel circuit 330 of FIG. 21.

Figure 26:
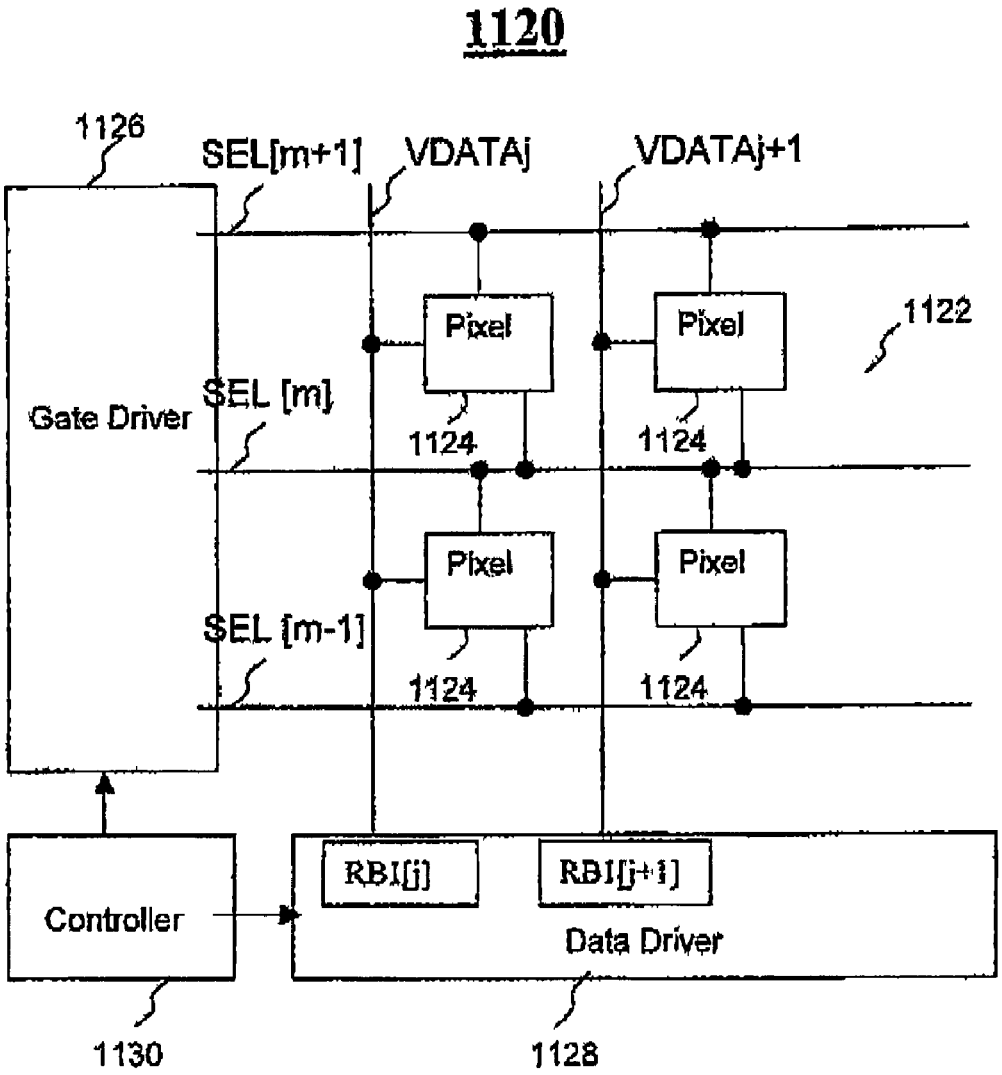
FIG. 26 is a diagram illustrating an example of a display system having a read back circuit of FIG. 25.

FIG. 26 illustrates an example of a display system having the read back circuit 360 of FIG. 25. The display system 1120 of FIG. 26 includes a display array 1122 having a plurality of pixels 1124. The pixel 1124 includes the drive circuit 304 of FIGS. 20 and 21, and may be the pixel circuit 300 of FIG. 20 or the pixel circuit 330 of FIG. 21. The pixel 1124 may be same or similar to the pixel 1084 of FIG. 23 or 1106 of FIG. 24.

In FIG. 26, four pixels 1124 are shown. However, the number of the pixels 1124 may vary in dependence upon the system design, and does not limited to four. In FIG. 26, three address lines and two data lines are shown. However, the number of the select lines and the data lines may vary in dependence upon the system design.

For each column, a read back circuit RB1[n] (n=j, j+1) and a switch SW1[n] (not shown) are provided. The read back circuit RB1[n] may include the SW1[n]. The read back circuit RB1[n] and the switch SW1[n] correspond to the read back 360 and the switch SW1 of FIG. 25, respectively. In the description below, the terms RB1 and RB1[n] may be used interchangeably, and RB1 may refer to the read back circuit 360 of FIG. 25 for a certain row.

The display array 1122 is an active matrix light emitting display. In one example, the display array 1122 is an AMOLED display array. The display array 1122 may be a single color, multi-color or a fully color display, and may include one or more than one electroluminescence (EL) element (e.g., organic EL). The display array 1122 may be used in mobiles, personal digital assistants (PDAs), computer displays, or cellular phones.

A gate driver 1126 includes an address driver for driving the address lines. The gate driver 1126 may be same or similar to the gate driver 1086 of FIG. 23 or the gate driver 1108 of FIG. 24. A data driver 1128 generates a programming data and drives the data lines. The data driver 1128 includes a circuit for calculating the programming data based on the output of the corresponding read back circuit RB1[n]. A controller 1130 controls the drivers 1126 and 1128 to drive the pixels 1124 as described above. The controller 1130 controls the switch SW1[n] to turn on or off so that the RB1[n] is connected to the corresponding data line VDATAn.

The pixels 1124 are operated to provide aging knowledge for the of-panel algorithm in which the programming voltage is calibrated at the controller 1130 or driver side 1128 according to the output voltage of the read back circuit RB1. A simple calibration can be scaling in which the programming voltage is scaled up by the change in the output voltage of the read back circuit RB1.

In FIG. 26, each of the pixels 1124 includes the sensor 316 of FIGS. 20 and 21. In another example, the display array 1120 may include one or more than one reference pixel having the sensor 316, as shown in FIG. 27.

Figure 27:
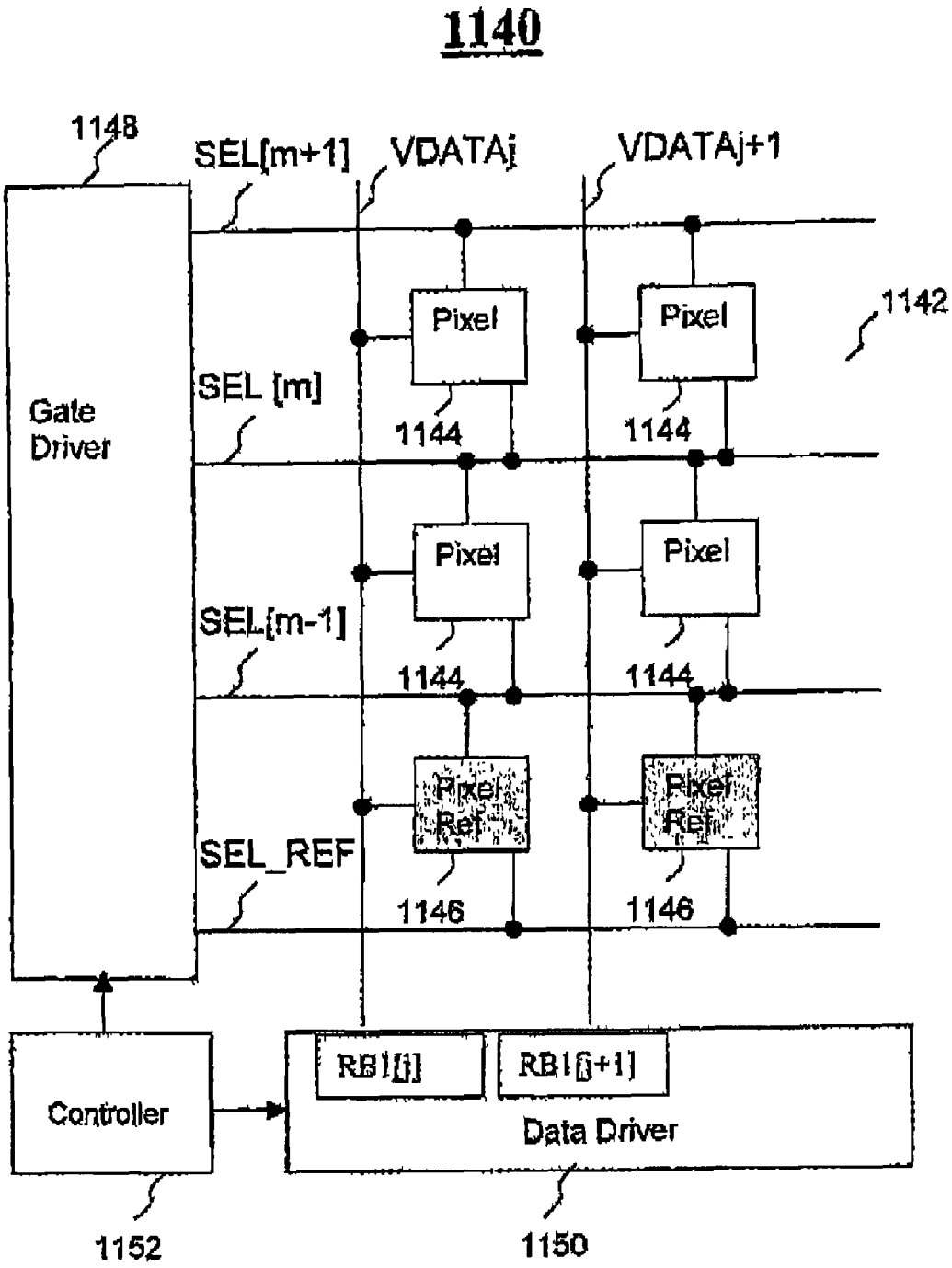
FIG. 27 is a diagram illustrating another example of a display system having the read back circuit of FIG. 25.

FIG. 27 illustrates another example of a display system having the read back circuit of FIG. 25. The display system 1140 of FIG. 27 includes a display array 1142 having a plurality of pixels 1144 and one or more than one reference pixels 1146. The reference pixel 1146 includes the drive circuit 304 of FIGS. 20 and 21, and may be the pixel circuit 300 of FIG. 20 or the pixel circuit 330 of FIG. 21. In FIG. 27, two reference pixels 1146 are shown. However, the number of the pixels 1084 may vary in dependence upon the system design, and does not limited to two. The pixel 1144 includes an OLED and a drive transistor for driving the OLED, and does not include the sensor 316 of FIGS. 20 and 21. SEL_REF is a select line for selecting the discharging transistors in the array of the reference pixels 1146.

A gate driver 1148 drives the address lines and the select line SEL_REF. The gate driver 1148 may be same or similar to the gate driver 1126 of FIG. 26. A data driver 1150 generates a programming data, calibrates the programming data and drives the data lines. The data driver 1150 may be same or similar to the data driver 1128 of FIG. 26. A controller 1152 controls the drivers 1148 and 1150.

The reference pixels 1146 are operated to provide aging knowledge for the of panel algorithm in which the programming voltage is calibrated at the controller 1152 or driver side 1150 according to the output voltage of the read back circuit RB1. A simple calibration can be scaling in which the programming voltage is scaled up by the change in the output voltage of the read back circuit RB1.

Figure 28:
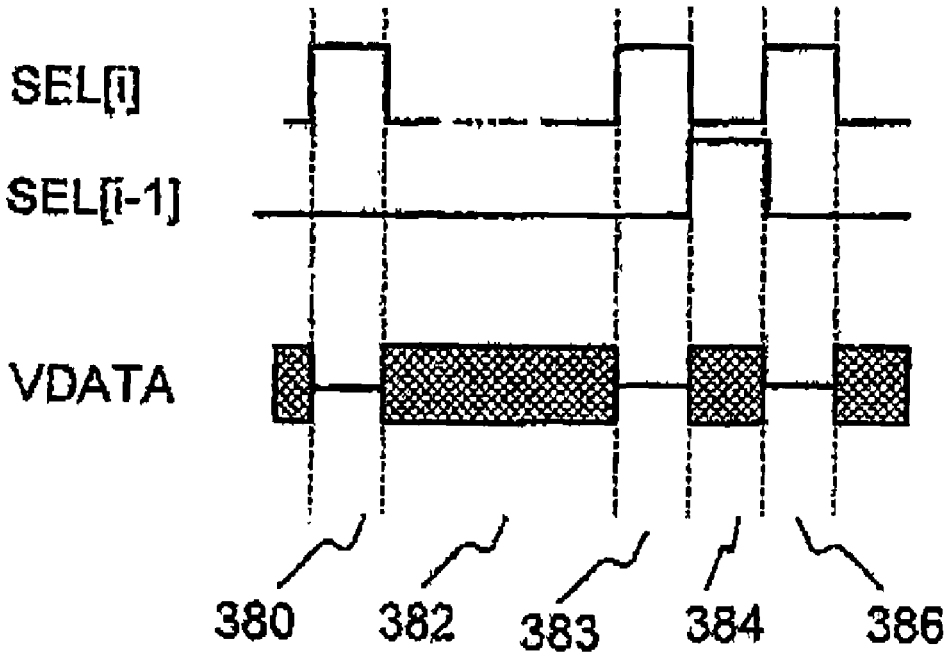
FIG. 28 is a timing diagram illustrating an example of a method of driving a pixel circuit in accordance with a fierier embodiment of the present invention.

FIG. 28 illustrates an example of a method of driving a pixel circuit in accordance with a further embodiment of the present invention. The display system 1120 of FIG. 26 and the display system 1140 of FIG. 27 are capable of operating according to the waveforms of FIG. 28. By applying the waveforms of FIG. 28 to the display system having the read back circuit (e.g., 360 of FIG. 3, RB1 of FIGS. 26 and 27), the of-panel calibration is implemented.

The operation cycles of FIG. 28 include operation cycles 380, 382, 383, 384, and 386. The operation cycle 380 is a programming cycle for the ith row. The operation cycle 382 is a driving cycle for the ith row. The driving cycle of each row is independent of the other rows. The operation cycle 383 is an initialization cycle for the ith row. The operation cycle 384 is an integration cycle for the ith row. The operation cycle 386 is a read back cycle for the ith row.

Referring to FIGS. 25 to 28, during the programming cycle 380 for the ith row, node A4 of the pixel circuit in the ith row is charged to a programming voltage through the switch transistor 308 while the select line SEL[i] is high. During the programming cycle 380 for the ith row, node A4 is charged to a calibrated programming voltage. During the driving cycle 382 for the ith row, the OLED luminance is controlled by the driver transistor 306. During the initialization cycle 383 for the ith row, node A4 is charged to a bias voltage. During the integration cycle 384 for the ith row, the SEL[i−1] is high and so the voltage at node A4 is discharged. Through the sensor 316. During the read back cycle 386, the change in the voltage at node A4 is read back to be used for calibration (e.g. scaling the programming voltage).

At the beginning of the read back cycle 384, the switch SW1 of the read back circuit RB1 is on, and the data line VDATA is charged to Vb2. Also the capacitor 364 is charged to a voltage, Vpre, as a result of leakage contributed from all the pixels connected to the date line VDATA. Then the select line SEL[i] goes high and so the discharged voltage Vdisch is developed across the capacitor 364. The difference between the two extracted voltages (Vpre and Vdisch) are used to calculate the pixel aging.

Figure 29:
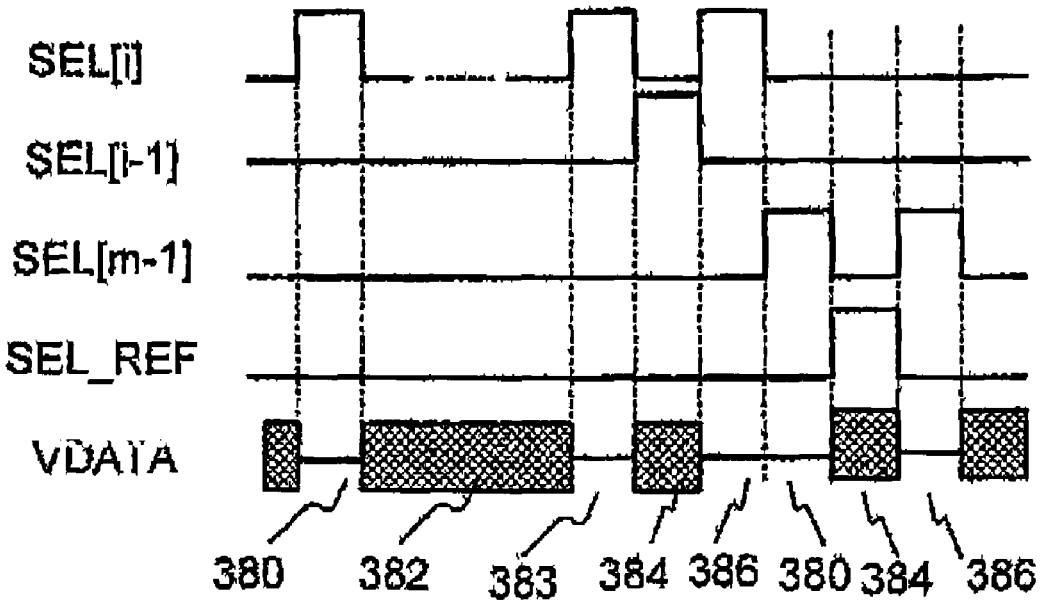
FIG. 29 is a diagram illustrating an example of a method of extracting the aging of a sensor of FIG. 25.

The sensor 316 can be OFF most of the time and be ON just for the integration cycle 384. Thus, the sensor 316 ages very slightly. In addition, the sensor 316 can be biased correctly to suppress its degradation significantly In addition, this method can be used for extracting the aging of the sensor 316. FIG. 29 illustrates an example of a method of extracting the aging of the sensor 316. The extracted voltages of the sensors for a dark pixel and a dark reference pixel can be used to find out the aging of the sensor 316. For example, the display system 1140 of FIG. 27 is capable of operating according to the waveforms of FIG. 29.

The operation cycles of FIG. 29 include operation cycles 380, 382, 383, 384, and 386. The operation cycle 380 is a programming cycle for the ith row. The operation cycle 382 is a driving cycle for the ith row. The operation cycle 383 is an initialization cycle for the ith row. The operation cycle 384 is an integration cycle for the ith row. The operation cycle 386 is a read back cycle for the ith row. The operation cycle 380 (the second occurrence) is an initialization for a reference row. The operation cycle 384 (the second occurrence) is an integration cycle for the reference row. The operation cycle 386 (the second occurrence) is a read back cycle (extraction) for the reference row.

The reference row includes one or more reference pixels (e.g., 1146 of FIG. 27), and is located in the (m−1)th row. SEL_REF is a select line for selecting the discharging transistors (e.g., 310 of FIG. 25) in the reference pixels in the reference row.

Referring to FIGS. 25, 27 and 29, to extract the aging of the sensor 316, a normal pixel circuit (e.g., 1144) is OFF. The difference between the extracted voltage via the output 316 from the normal pixel and voltage extracted for the OFF state of the reference pixel (e.g., 1146) is extracted. The voltage for the OFF state of the reference pixel is extracted where the reference pixel is not under stress. This difference results in the extraction of the degradation of the sensor 316.

Figure 30:
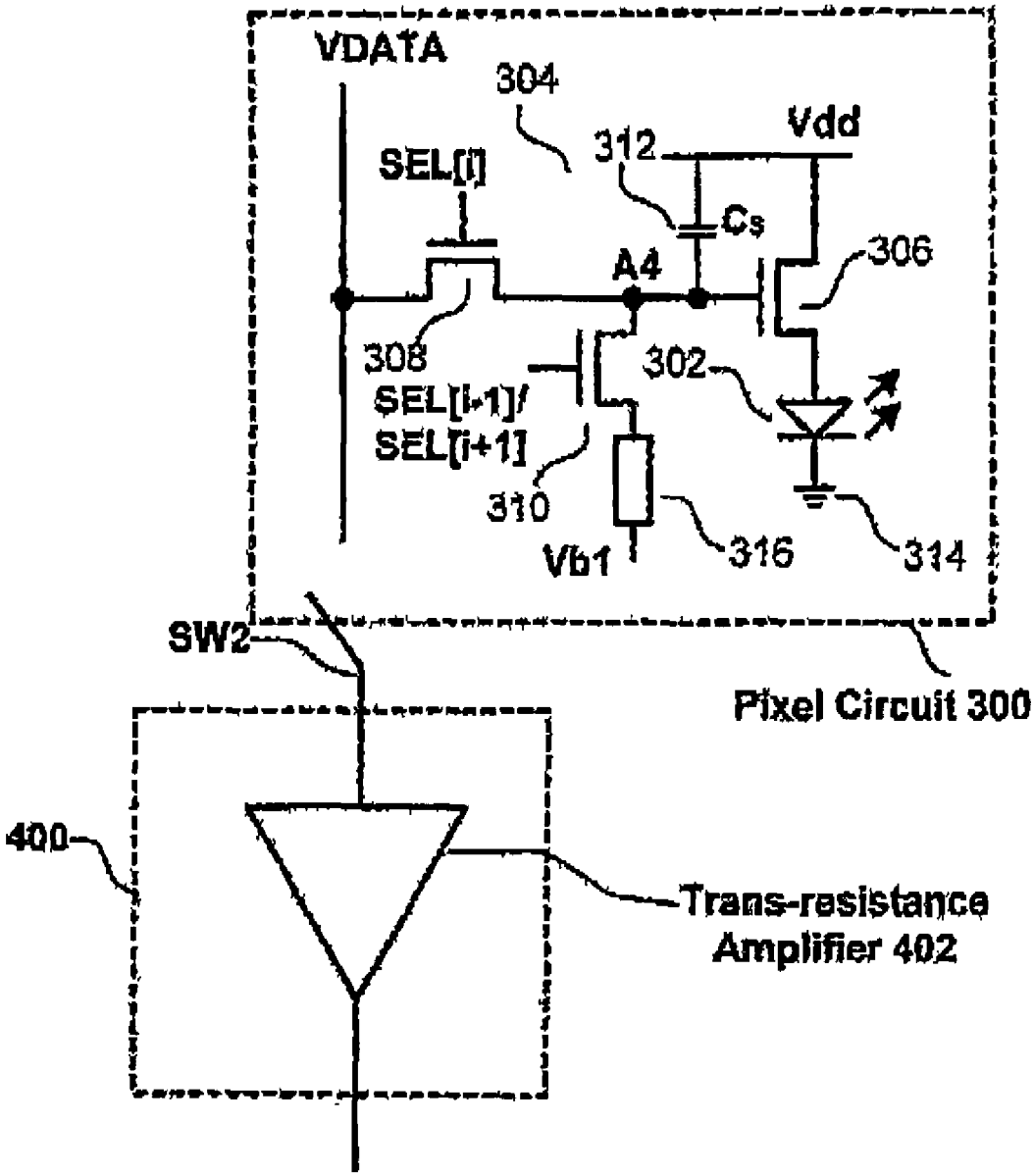
FIG. 30 is a diagram illustrating an example of a pixel system in accordance with another embodiment of the present invention.

FIG. 30 illustrates an example of a pixel system in accordance with another embodiment of the present invention. The pixel system of FIG. 30 includes a read back circuit 400. The read-back circuit 400 includes a trans-resistance amplifier 402. One terminal of the trans-resistance amplifier 402 is connectable to the data line VDATA via a switch SW2. The trans-resistance amplifier 402 reads back the voltage discharged from the node A4 via the switch SW2. The switch SW2 may be same or similar to the switch SW1 of FIG. 25.

The output of the trans-resistance amplifier 402 varies in dependent upon the voltage at node A4. The time depending characteristics of the pixel circuit is readable from node A4 via the trans-resistance amplifier 402.

In FIG. 30, one read back circuit 400 and one switch SW2 are illustrated for one pixel circuit. However, the read back circuit 400 and the switch SW2 may be provided for a group of pixel circuits (e.g., pixel circuits in a column). In FIG. 30, the read back circuit 400 and the switch SW2 are provided to the pixel circuit 300. In another example, the read back circuit 400 and the switch SW2 are applied to the pixel circuit 330 of FIG. 21.

Figure 31:
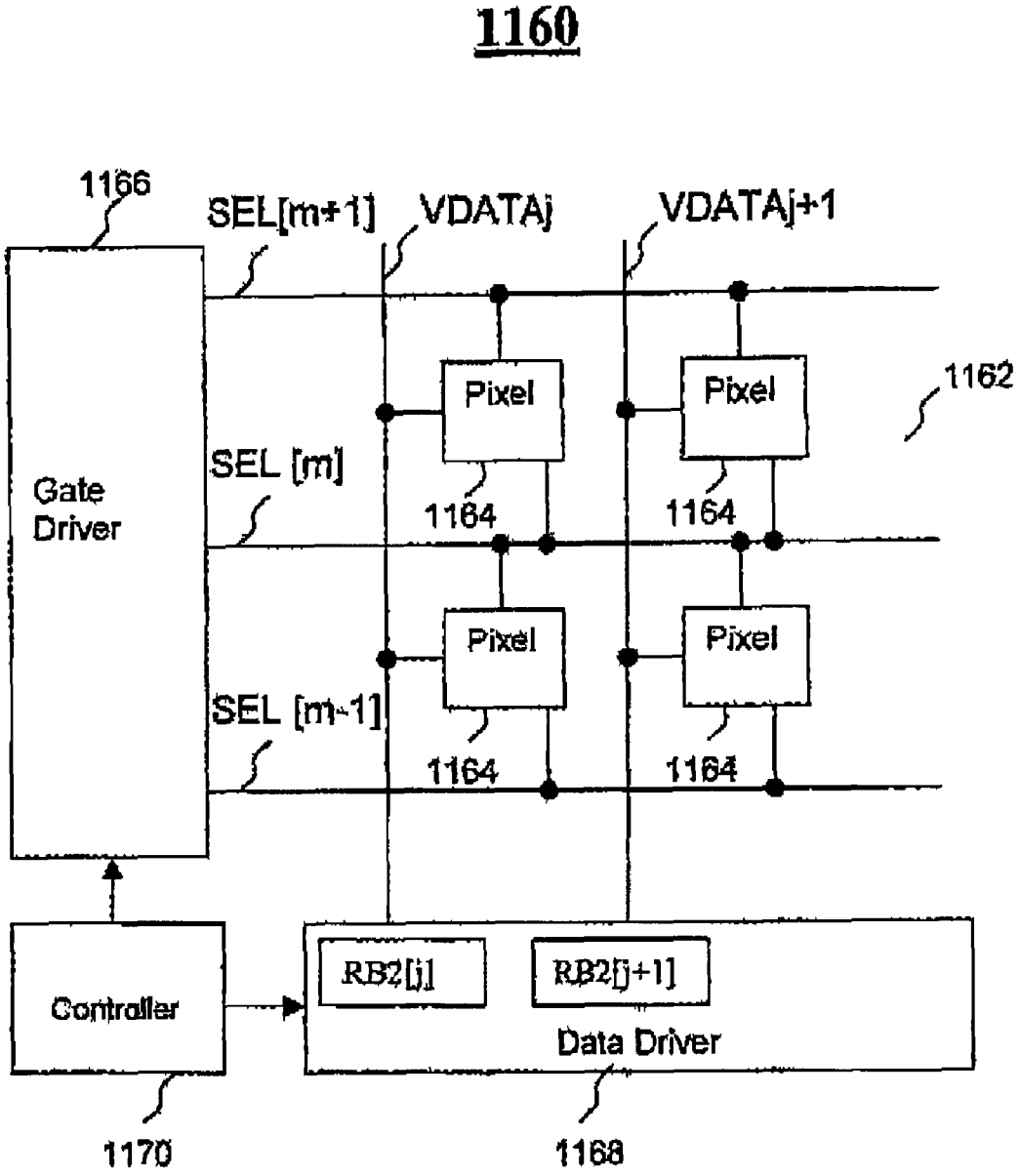
FIG. 31 is a diagram illustrating an example of a display system having a read back circuit of FIG. 30.

FIG. 31 illustrates an example of a display system having the read back circuit 400 of FIG. 30. The display system 1160 of FIG. 31 includes a display array 1162 having a plurality of pixels 1164. The pixel 1164 includes the drive circuit 304 of FIGS. 20 and 21, and may be the pixel circuit 300 of FIG. 20 or the pixel circuit 330 of FIG. 21. The pixel 1164 may be same or similar to the pixel 1124 of FIG. 26 or 1146 of FIG. 27.

In FIG. 31, four pixels 1164 are shown. However, the number of the pixels 1164 may vary in dependence upon the system design, and does not limited to four. In FIG. 31, three address lines and two data lines are shown. However, the number of the select lines and the data lines may vary in dependence upon the system design.

For each column, a read back circuit RB2[n] (n=j, j+1) and a switch SW2[n] (not shown) are provided. The read back circuit RB2[n] may include the SW2[n]. The read back circuit RB2[n] and the switch SW2[n] correspond to the read back 400 and the switch SW2 of FIG. 30, respectively. In the description below, the terms RB2 and RB2[n] may be used interchangeably, and RB2 may refer to the read back circuit 400 of FIG. 30 for a certain row.

The display array 1162 is an active matrix light emitting display. In one example, the display array 1162 is an AMOLED display array. The display array 1162 may be a single color, multi-color or a fully color display, and may include one or more than one electroluminescence (EL) element (e.g., organic EL). The display array 1162 may be used in mobiles, personal digital assistants (PDAs), computer displays, or cellular phones.

A gate driver 1166 includes an address driver for driving the address lines. The gate driver 1166 may be same or similar to the gate driver 1126 of FIG. 26 or the gate driver 1148 of FIG. 27. A data driver 1168 generates a programming data and drives the data lines. The data driver 1168 includes a circuit for calculating the programming data based on the output of the corresponding read back circuit RB2[n]. A controller 1170 controls the drivers 1166 and 1168 to drive the pixels 1164 as described above. The controller 1170 controls the switch SW2[n] to turn on or off so that the RB2[n] is connected to the corresponding data line VDATAn.

The pixels 1164 are operated to provide aging knowledge for the of-panel algorithm in which the programming voltage is calibrated at the controller 1170 or driver side 1168 according to the output voltage of the read back circuit RB2. A simple calibration can be scaling in which the programming voltage is scaled up by the change in the output voltage of the read back circuit RB2.

In FIG. 31, each of the pixels 1164 includes the sensor 316 of FIGS. 20 and 21. In another example, the display array 1160 may include one or more than one reference pixel having the sensor 316, as shown in FIG. 32.

Figure 32:
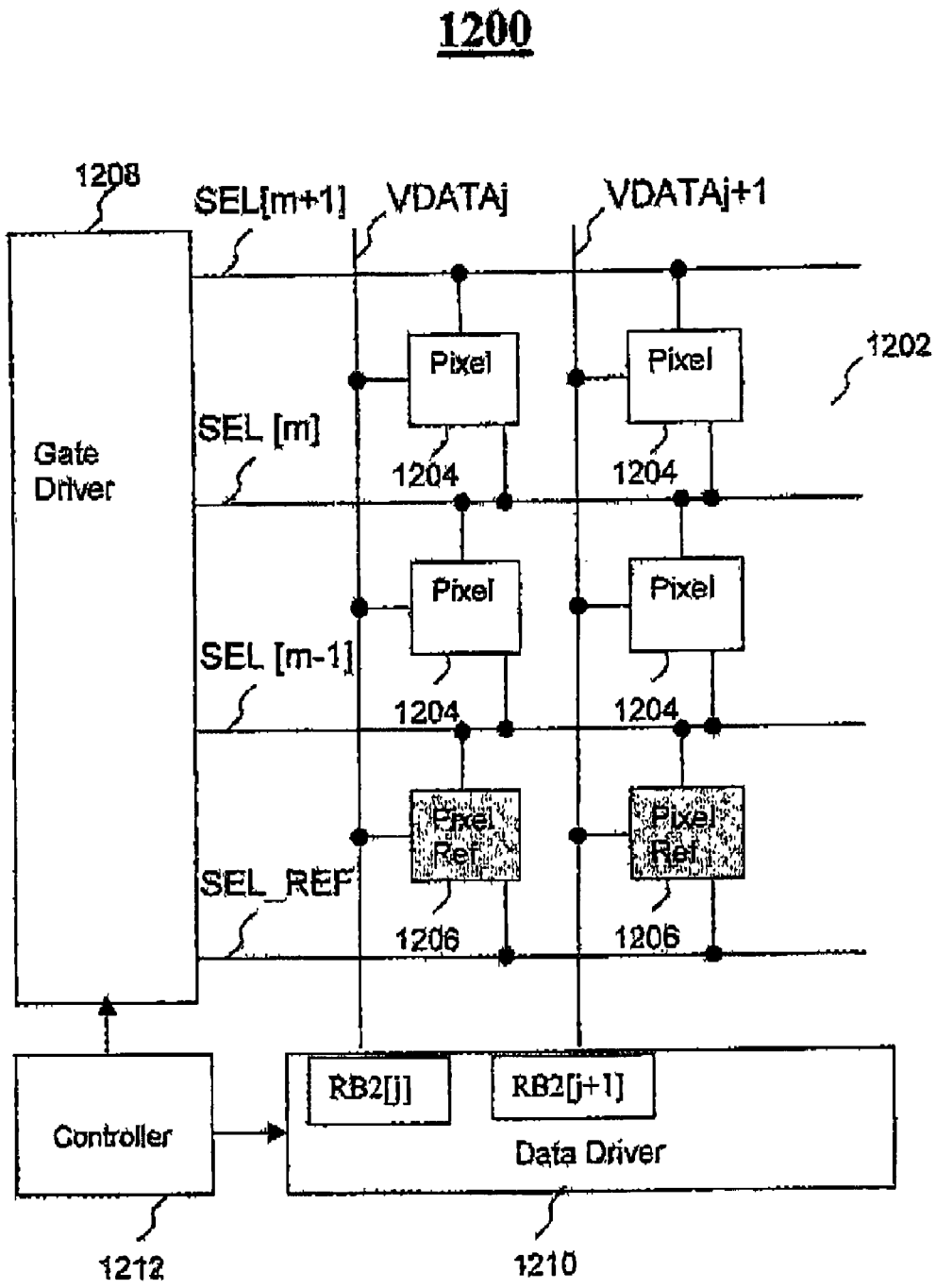
FIG. 32 is a diagram illustrating another example of a display system having the read back circuit of FIG. 30.

FIG. 32 illustrates another example of a display system having the read back circuit 400 of FIG. 30. The display system 1200 of FIG. 32 includes a display array 1202 having a plurality of pixels 1204 and one or more than one reference pixels 1206. The reference pixel 1206 includes the drive circuit 304 of FIGS. 20 and 21, and may be the pixel circuit 300 of FIG. 20 or the pixel circuit 330 of FIG. 21. In FIG. 32, two reference pixels 1206 are shown. However, the number of the pixels 1204 may vary in dependence upon the system design, and does not limited to two. The pixel 1204 includes an OLED and a drive transistor for driving the OLED, and does not include the sensor 316 of FIGS. 20 and 21. SEL_REF is a select line for selecting the discharging transistors in the array of the reference pixels 1206.

A gate driver 1208 drives the address lines and the select line SEL_REF. The gate driver 1208 may be same or similar to the gate driver 1148 of FIG. 27 or the gate driver 1166 of FIG. 31. A data driver 1210 generates a programming data, calibrates the programming data and drives the data lines. The data driver 1210 may be same or similar to the data driver 1150 of FIG. 27 or the data driver 1168 of FIG. 32. A controller 1212 controls the drivers 1208 and 1210.

The reference pixels 1206 are operated to provide aging knowledge for the of-panel algorithm in which the programming voltage is calibrated at the controller 1212 or driver side 1210 according to the output voltage of the read back circuit RB2. A simple calibration can be scaling in which the programming voltage is scaled up by the change in the output voltage of the read back circuit RB2.

Figure 33:
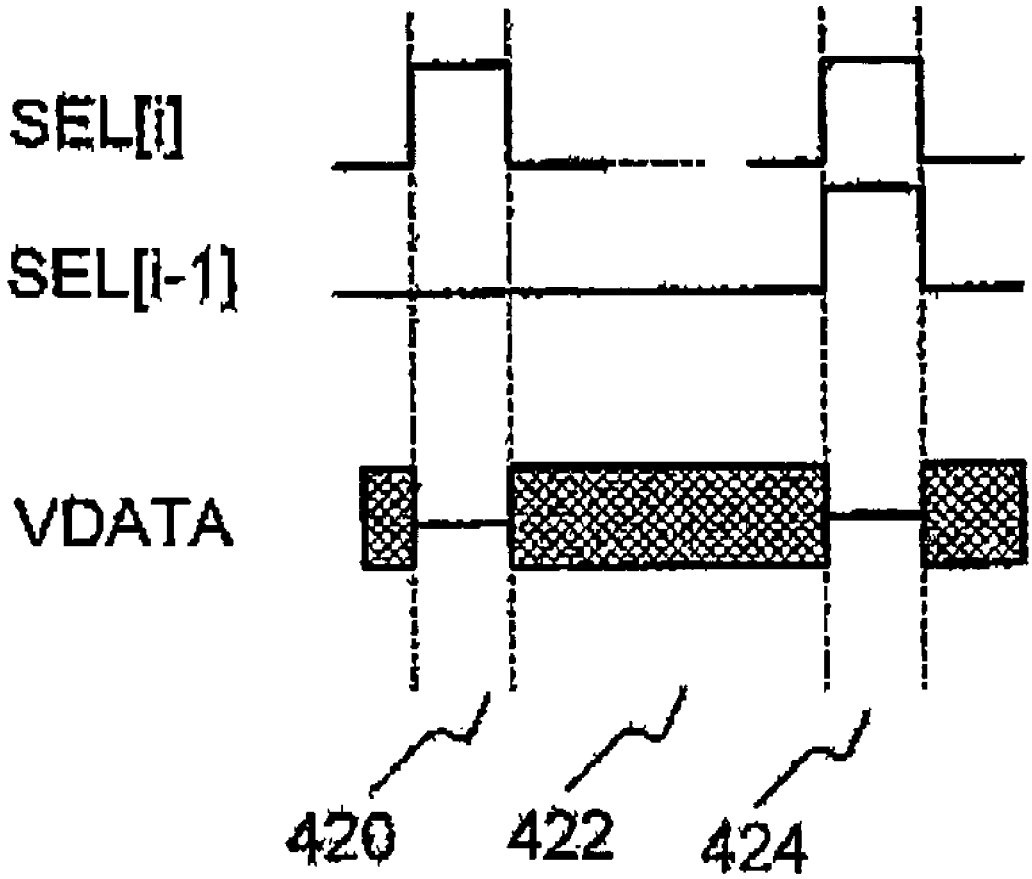
FIG. 33 is a timing diagram illustrating an example of a method of driving a pixel circuit in accordance with a further embodiment of the present invention.

FIG. 33 illustrates an example of a method of driving a pixel circuit in accordance with a further embodiment of the present invention. The display system 1160 of FIG. 31 and the display system 1200 of FIG. 32 are capable of operating according to the waveforms of FIG. 33. By applying the waveforms of FIG. 33 to the display system having the read back circuit (e.g., 400 of FIG. 30, RB2 of FIGS. 31 and 32), the of-panel calibration is implemented.

The operation cycles of FIG. 33 include operation cycles 410, 422 and 422 for a row. The operation cycle 420 is a programming cycle for the ith row. The operation cycle 422 is a driving cycle for the ith row. The operation cycle 424 is a read back (extraction) cycle for the ith row Referring to FIG. 30 to 33, during the programming cycle 420 for the ith row, node A4 of the pixel circuit in the ith row is charged to a programming voltage trough the switch transistor 308 while the select line SEL[i] is high. During the driving cycle 422 for the ith row, the pixel luminance is controlled by the current of the drive transistor 306. During the extraction cycle 424 for the ith row, SEL [i] and SEL[i−1] are high and the current of the sensor 316 is monitored. The change in this current is amplified by the read back circuit RB2. This change is used to measured the luminance degradation in the pixel and compensate for it by calibrating the programming voltage (e.g. scaling the programming voltage).

At the beginning of the read-back cycle 424, the switch SW2 for the row that the algorithm chooses for calibration is ON while SEL[i] is low. Therefore, the leakage current is extracted as the output voltage of the trans-resistance amplifier 402. The selection of the row can be based on stress history, random, or sequential technique. Next, SEL[i] goes high and so the sensor current related to the luminance or temperature of the pixel is read back as the output voltage of the trans-resistance amplifier 402. Using the two extracted voltages for leakage current and sensor current, one can calculated the pixel aging.

Figure 34:
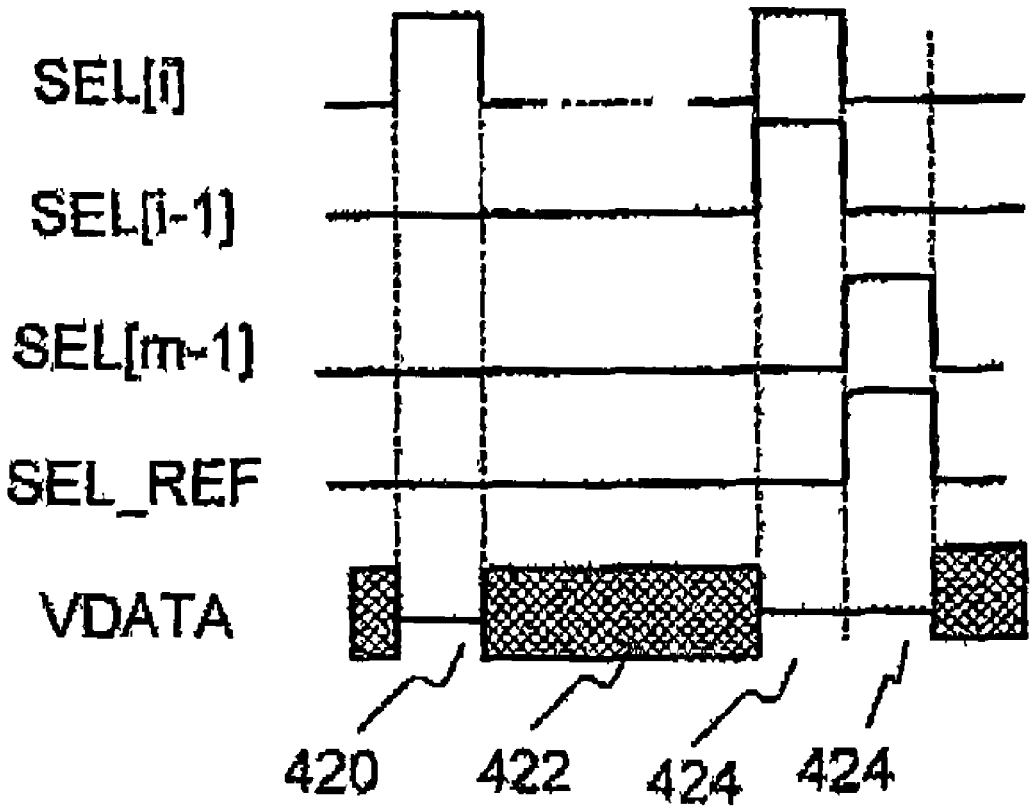
FIG. 34 is a timing diagram illustrating another example of a method of extracting the aging of a sensor of FIG. 30.

The sensor 316 can be OFF most of the time and be ON just for the operation cycle 424. Thus, the sensor 316 ages very slightly. In addition, the sensor 316 can be biased correctly to suppress its degradation significantly In addition, this method can be used for extracting the aging of the sensor 316, FIG. 34 illustrates an example of a method of extracting the aging of the sensor 316 of FIG. 30. For example, the display system 1200 of FIG. 32 operates according to the waveforms of FIG. 34.

The operation cycles of FIG. 34 include operation cycles 420, 422 and 424. The operation cycle 420 (the first occurrence) is a programming cycle for the ith row. The operation cycle 422 is a driving cycle for the ith row. The operation cycle 424 (the first occurrence) is a read back (extraction) cycle for the ith row. The operation cycle 424 (the second occurrence) is a read back (extraction) cycle for a reference row.

The reference row includes one or more reference pixels (e.g., 1206 of FIG. 32) and is located in the (m−1)th row. SEL_REF is a select line for selecting the discharging transistors (e.g., 310 of FIG. 30) in the reference pixels in the reference row.

Referring to FIGS. 30, 32 and 34, to extract the aging of the sensor 316, a normal pixel circuit (e.g., 1204) is OFF. The difference between the extracted voltage via the output of the trans-resistance amplifier 402 from the normal pixel circuit and voltage extracted for the OFF state of the reference pixel (e.g., 1206) is extracted. The voltage for the OFF state of the reference pixel is extracted where the reference pixel is not under stress. This results in the extraction of the degradation of the sensor 316.

Figure 35:
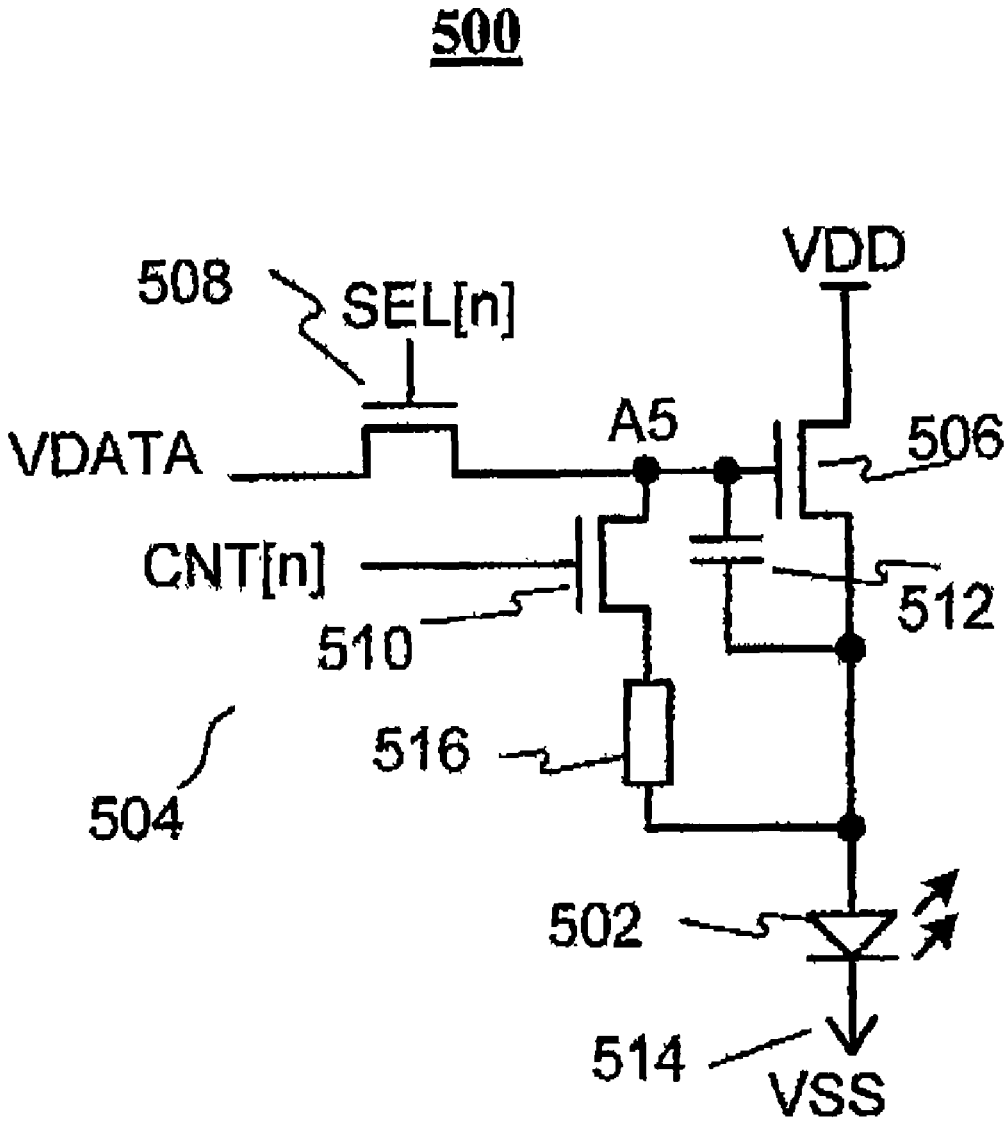
FIG. 35 is a diagram illustrating an example of a pixel circuit to which a pixel drive scheme in accordance with a further embodiment of the present invention is applied.

FIG. 35 illustrates an example of a pixel circuit to which a pixel drive scheme in accordance with a further embodiment of the present invention. The pixel circuit 500 of FIG. 35 includes an OLED 502 and a drive circuit 504 for driving the OLED 502. The drive circuit 504 includes a drive transistor 506, a switch transistor 508, a discharging transistor 510, an adjusting circuit 510, and a storage capacitor 512.

The OLED 502 may be same or similar to the OLED 212 of FIG. 13 or the OLED 302 of FIG. 20. The capacitor 512 may be same or similar to the capacitor 224 of FIG. 13 or the capacitor 312 of FIG. 20. The transistors 506, 508 and 510 may be same or similar to the transistors 206, 220, and 222 of FIG. 13 or the transistors 306, 308 and 310 of FIG. 20. In one example, each of the transistors 506, 508 and 510 includes a gate terminal, a source terminal and a drain terminal.

The drive transistor 506 is provided between a voltage supply line VDD and the OLED 502. One terminal (e.g., drain) of the drive transistor 506 is connected to VDD. The other terminal (e.g., source) of the drive transistor 506 is connected to one electrode (e.g., anode electrode) of the OLED 502. The other electrode (e.g., cathode electrode) of the OLED 502 is connected to a power supply line VSS (e.g., common ground) 514. One terminal of the storage capacitor 512 is connected to the gate terminal of the drive transistor 506 at node A5. The other terminal of the storage capacitor 512 is connected to the OLED 502. The gate terminal of the switch transistor 508 is connected to a select line SEL [n]. One terminal of the switch transistor 508 is connected to data line VDATA. The other terminal of the switch transistor 508 is connected to node A5. The gate terminal of the transistor 510 is connected to a control line CNT[n]. In one example, a represents the nth row in a display array. One terminal of the transistor 510 is connected to node A5. The other terminal of the transistor 510 is connected to one terminal of the adjusting circuit 516. The other terminal of the adjusting circuit 516 is connected to the OLED 502.

The adjusting circuit 516 is provided to adjust the voltage of A5 with the discharging transistor 510 since its resistance changes based on the pixel aging. In one example, the adjusting circuit 516 is the transistor 218 of FIG. 13. In another example, the adjusting circuit 516 is the sensor 316 of FIG. 20.

To improve the shift in the threshold voltage of the drive transistor 506, the pixel circuit is turned off for a portion of frame time.

Figure 36:
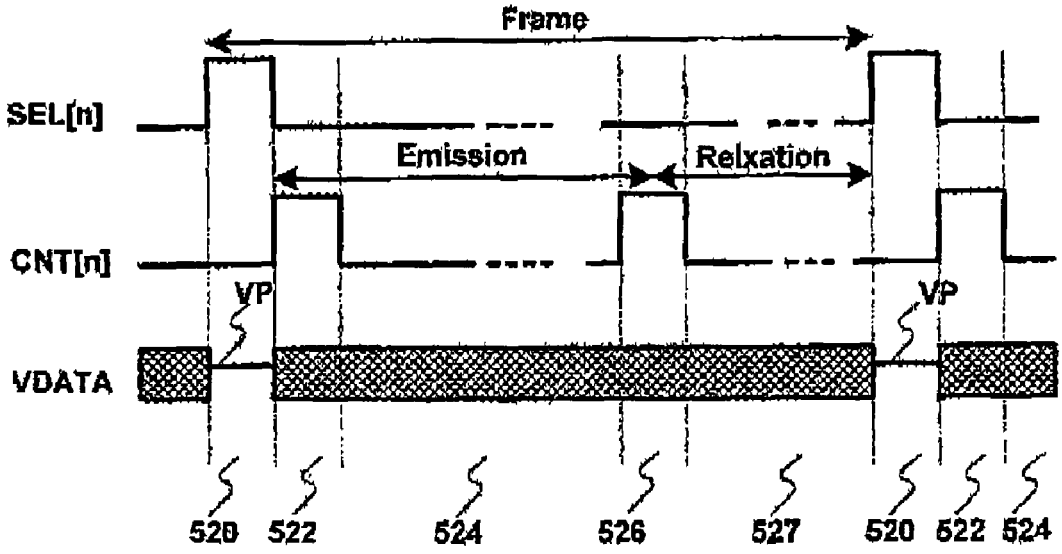
FIG. 36 is a timing diagram for an example of a method of driving a pixel circuit in accordance with a further embodiment of the present invention.

FIG. 36 illustrates an example of a method of driving a pixel circuit in accordance with a flintier embodiment of the invention. The waveforms of FIG. 36 are applied to the pixel circuit of FIG. 35. The operation cycles for the pixel circuit 500 include a programming cycle 520, a discharge cycle 522, an emission cycle 524, a reset cycle 526, and a relaxation cycle 527.

During the programming cycle 520, node A5 is charged to a programming voltage VP. During the discharge cycle 522, CNT[n] goes high, and the voltage at node A5 is discharge partially to compensate for the aging of the pixel. During the emission cycle 524, SEL[n] and CNT[n] go low. The OLED 502 is controlled by the drive transistor 506 during the emission cycle 524. During the reset cycle 526, the CNT[n] goes to a high voltage so as to discharge the voltage at node A5 completely during the reset cycle 526. During the relaxation cycle 527, the drive transistor 506 is not under stress and recovers from the emission 524. Therefore, the aging of the drive transistor 506 is reduced significantly.

Figure 37:
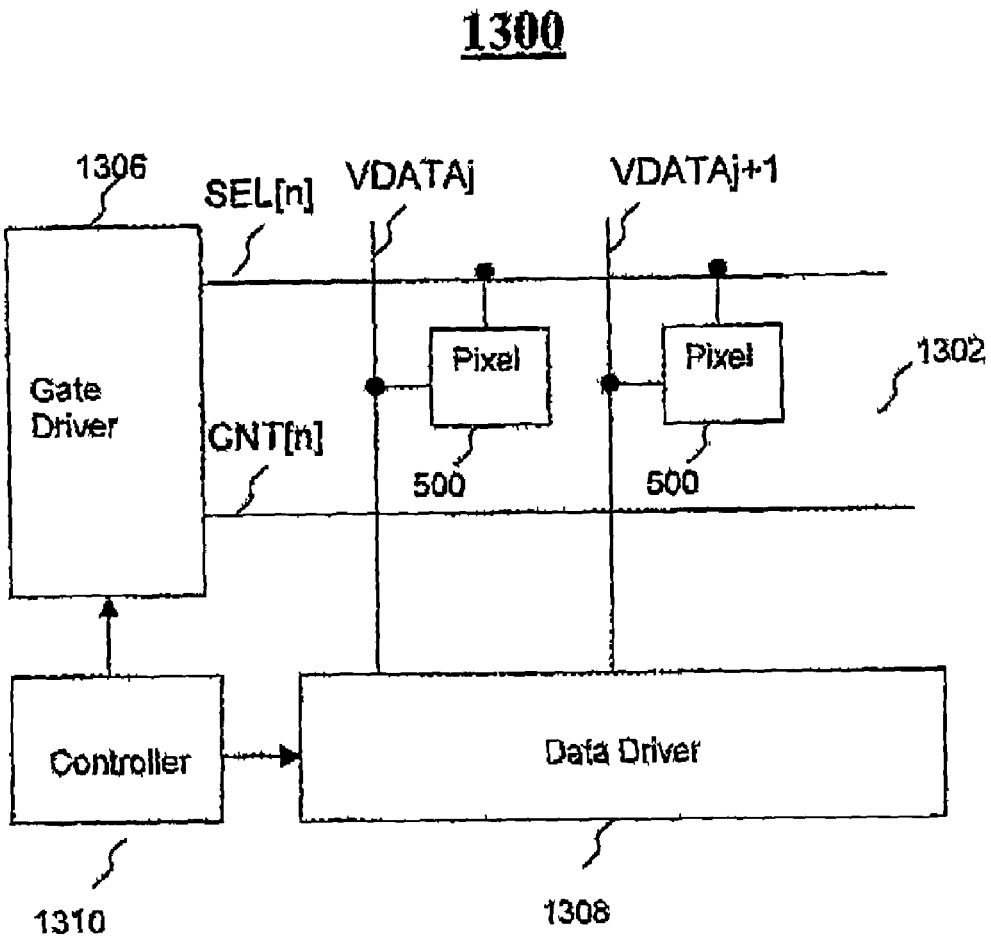
FIG. 37 is a diagram illustrating an example of a display system having the pixel circuit of FIG. 35.

FIG. 37 illustrates an example of a display system including the pixel circuit of FIG. 35. The display system 1300 of FIG. 37 includes a display array 1302 having a plurality of pixels 500. The display array 1302 is an active matrix light emitting display. In one example, the display wary 1302 is an AMOLED display array. The pixels 500 are arranged in rows and columns. In FIG. 37, two pixels 500 for the nth row are shown. The display array 1302 may include more than two pixels.

The display array 1302 may be a single color, multi-color or a fully color display, and may include one or more than one electroluminescence (EL) element (e.g., organic EL). The display array 1302 may be used in mobiles, personal digital assistants (PDAs), computer displays, or cellular phones.

Address line SEL[n] is proved to the nth row. Control line CNT[n] is proved to the nth row. Data line VDATAk (k=j, j+1) is proved to the kth column. The address line SEL[n] corresponds to SEL[n] of FIG. 35. The control line CNT[n] corresponds to CNT[n] of FIG. 35. The data Line VDATAk (k=j, j+1) corresponds to VDATA of FIG. 35.

A gate driver 1306 drives SEL[n]. A data driver 1308 generates a programming data and drives VDATAk. A controller 1310 controls the drivers 1306 and 1308 to drive the pixels 500 to produce the waveforms of FIG. 36.

Figure 38:
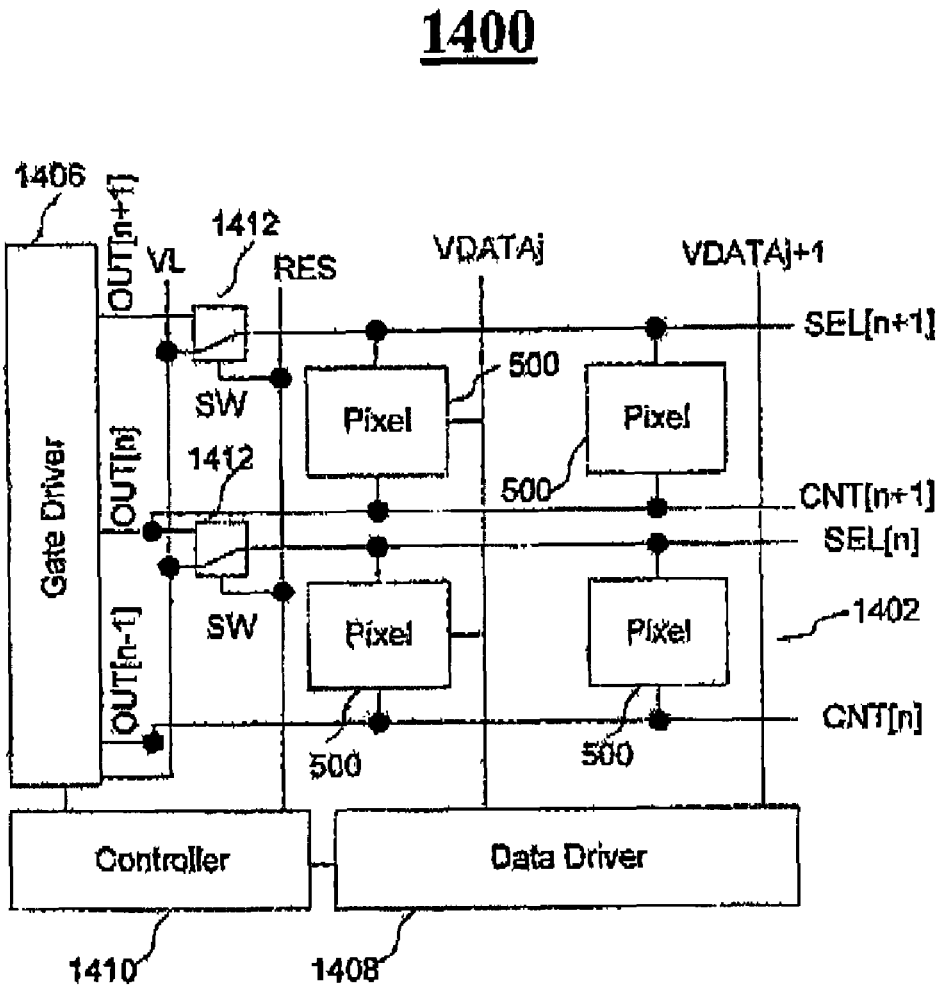
FIG. 38 is a diagram illustrating another example of a display system having the pixel circuit of FIG. 35.

FIG. 38 illustrates another example of a display system including the pixel circuit 500 of FIG. 35. The display system 1400 of FIG. 38 includes a display array 1402 having a plurality of pixels 500. The display array 1402 is an active matrix light emitting display. In one example, the display array 1302 is an AMOLED display array. The pixels 500 are arranged in rows and columns. In FIG. 38, four pixels 500 for the nth row are shown. The display array 1402 may include more than four pixels.

SEL[i] (i=n, n+1) is a select line and corresponds to SEL[n] of FIG. 35. CNT[i] (i=n, n+1) is a control line and corresponds to CNT[n] of FIG. 35, OUT[k] (k=n−1, n, n+1) is an output from a gate driver 1406. The select line is connectable to one of the outputs from the gate driver 1402 or VL line. VDATAm (m=j, j+1) is a data line and corresponds to VDATA of FIG. 35. VDATAm is controlled by a data driver 1408. A controller 1410 controls the gate driver 1406 and the data driver 1408 to operate the pixel circuit 500.

The control lines and select lines share the same output from the gate driver 1406 through switches 1412. During the discharge cycle 526 of FIG. 36, RES signal changes the switches 1412 direction and connect the select lines to the VL line which has a low voltage to turn off the transistor 508 of the pixel circuit 500, OUT[n−1] is high and so CNT[n] is high. Thus the voltage at node A5 is adjusted by the adjusting circuit 516 and discharging transistor 510. During other operation cycles, RES signal and switches 1412 connect the select lines to the corresponding output of the gate driver (e.g., SEL[n] to OUT[n]). The switches 1412 can be fabricated on the panel using the panel fabrication technology (e.g. amorphous silicon) or it can be integrated inside the gate driver.

According to the embodiments of the present invention, the drive circuit and the waveforms applied to the drive circuit provide a stable AMOLED display despite the instability of backplane and OLED. The drive circuit and its waveforms reduce the effects of differential aging of the pixel circuits. The pixel scheme in the embodiments does not require any additional driving cycle or driving circuitry, resulting in a row cost application for portable devices including mobiles and PDAs. Also it is insensitive to the temperature change and mechanical stress, as it would be appreciated by one of ordinary skill in the art.

One or more currently preferred embodiments have been described by way of examples as described above. It will be apparent to persons skilled in the art that a number of variations and modifications can be made without departing from the scope of the invention as defined in the claims.

What is claimed is:

1. A display system, comprising:

a pixel circuit having a light emitting device and including:

a drive transistor connected to the light emitting device, the drive transistor including a gate terminal, a first terminal and a second terminal;

a first switch transistor including a gate terminal, a first terminal and a second terminal, the gate terminal of the first switch transistor being connected to a select line, the first terminal of the first switch transistor being connected to a data line providing voltage programming information, the second terminal of the first switch transistor being connected to the gate terminal of the drive transistor; and a circuit for adjusting the gate voltage of the drive transistor by discharging the voltage on the gate terminal of the drive transistor through a discharging transistor having a resistance that changes based on the aging of the pixel circuit, a gate terminal of the discharging transistor being connected to the gate terminal of the drive transistor at a node, the circuit for adjusting further including a second switch transistor connected between the discharging transistor and the gate terminal of the drive transistor.

2. The display system according to claim 1, wherein the voltage of the node is at least partially discharged through the discharging transistor after the pixel circuit is programmed according to the voltage programming information and prior to the completion of an emission cycle during which the light emitting device is driven to emit light according to the voltage programming information; and wherein the pixel circuit further includes:

a storage capacitor including a first terminal and a second terminal, the first terminal of the storage capacitor being connected to the gate terminal of the drive transistor at the node.

3. The display system according to claim 2, wherein the first terminal of the discharging transistor is connected to the gate terminal of the drive transistor through the second switch transistor.

4. The display system according to claim 2, wherein the second switch transistor includes a gate terminal, a first terminal and a second terminal, the gate terminal of the second switch transistor being connected to a bias line, the first terminal of the second switch transistor being connected to the gate terminal of the drive transistor, the second terminal of the second switch transistor being connected to the first terminal of the discharging transistor.

5. The display system according to claim 4, wherein the pixel is one of a plurality of similar pixel circuits arranged in rows and columns, the display system further comprising:

a display array including the plurality of similar pixel circuits; and a driver for driving the display array, and wherein the bias line is shared by more than one pixel circuit of the plurality of similar pixel circuits.

6. The display system according to claim 2, wherein the light emitting device comprises a first electrode, a second electrode, and an emission layer between the first electrode and the second electrode, and wherein the first terminal of the drive transistor is connected to one of the first electrode and the second electrode, and wherein the second terminal of the drive transistor, the second terminal of the discharging transistor and the second terminal of the storage capacitor are connected to a power supply.

7. The display system according to claim 2, wherein the light emitting device comprises a first electrode, a second electrode, and an emission layer between the first electrode and the second electrode, and wherein the second terminal of the drive transistor, the second terminal of the discharging transistor and the second terminal of the storage capacitor are connected to one of the first electrode and the second electrode, and wherein the first terminal of the drive transistor is connected to a power supply.

8. The display system according to claim 1, wherein said transistors are formed in amorphous, poly, n-type, p-type, CMOS, microcrystalline, nanocrystalline, crystalline silicon or combinations thereof.

9. The display system according to claim 1, wherein the pixel circuit is one of a plurality of similar pixel circuits arranged in rows and columns, the display system further comprising:

a display array including the plurality of similar pixel circuits; and a driver for driving the display array.

10. The display system of claim 1 in which said changes in said resistance of said discharging transistor causes a discharge time of said gate terminal of said drive transistor to increase as the pixel circuit ages so as to apply an average current to said light emitting device during an emission cycle that is substantially independent of a threshold voltage shift of said drive transistor.

11. The display system of claim 1, wherein the second terminal of the discharging transistor is connected to the second terminal of the drive transistor so that the drive transistor and the discharging transistor have the same bias condition and thus experience the same threshold voltage shift, the voltage of the node being at least partially discharged through the discharging transistor.

12. The display system of claim 1, wherein the drive circuit is configured to at least partially discharge the node through the discharging transistor after the pixel circuit is programmed according to the voltage programming information and prior to completion of an emission cycle during which the light emitting device is driven to emit light according to the voltage programming information.

13. The display system of claim 12, wherein the drive circuit is configured to at least partially discharge the node through the discharging transistor while the drive transistor is driving the light emitting device to emit light during an emission cycle so as to apply an average current to the light emitting device during the emission cycle that is substantially independent of a threshold voltage shift of the drive transistor.

14. The display system according to claim 1, wherein a first terminal of the discharging transistor is connected to the gate terminal of the drive transistor, a second terminal of the discharging transistor being connected to the second terminal of the drive transistor so that the drive transistor and the discharging transistor have the same bias condition and thus experience the same threshold voltage shift, the voltage of the node being at least partially discharged through the discharging transistor and the second switch transistor.

15. A display system, comprising: a display array including a plurality of pixel circuits arranged in rows and columns, each including a light emitting device and a drive circuit; and a drive system for driving the display array, each drive circuit including:

a drive transistor including a gate terminal, a first terminal and a second terminal, the drive transistor being between the light emitting device and a first power supply;

a first switch transistor including a gate terminal, a first terminal and a second terminal, the gate terminal of the first switch transistor being connected to an address line, the first terminal of the first switch transistor being connected to a data line for providing voltage programming information, the second terminal of the first switch transistor being connected to the gate terminal of the drive transistor; and a circuit for adjusting the gate voltage of the drive transistor by discharging the voltage on the gate terminal of the drive transistor through a discharging transistor having a resistance that changes based on the aging of the pixel circuit, a gate terminal of the discharging transistor being connected to the gate terminal of the drive transistor at a node, the circuit for adjusting further including a second switch transistor connected between the discharging transistor and the gate terminal of the drive transistor.

16. The display system according to claim 15, wherein the drive system comprises a first driver having a drive output for each row, a second driver for driving the data line for each column, and a switch for each row, the address line for a row being selectively connected to the corresponding drive output of the first driver or a voltage line having a predetermined voltage level by the corresponding switch.

17. The display system according to claim 15, wherein a control line for each row is connected to a drive output different from that of the address line for each row.

18. The display system of claim 15, in which each drive circuit further includes a storage capacitor having a first terminal and a second terminal, the first terminal of the storage capacitor being connected to the gate terminal of the drive transistor at a node, and wherein the voltage of the node is at least partially discharged through the discharging transistor after the pixel circuit is programmed according to the voltage programming information.

19. The display system according to claim 15, wherein the light emitting device in each of the plurality of pixel circuits includes an organic light emitting diode.

20. A display system comprising a display array including a plurality of pixel circuits arranged in rows and columns, and a drive system for driving the display array, each pixel circuit in the plurality of pixel circuits including a light emitting device and a drive circuit, each drive circuit including:

a drive transistor including a gate terminal, a first terminal and a second terminal, the drive transistor being between the light emitting device and a first power supply;

a first switch transistor including a gate terminal, a first terminal and a second terminal, the gate terminal of the first switch transistor being connected to an address line, the first terminal of the first switch transistor being connected to a data line for providing voltage programming information, the second terminal of the first switch transistor being connected to the gate terminal of the drive transistor; and a circuit for adjusting the gate voltage of the drive transistor by discharging the voltage on the gate terminal of the drive transistor through a component having a resistance that changes based on the aging of the pixel circuit, wherein the drive system is configured to provide a frame time having a programming cycle, a discharge cycle, an emission cycle, a reset cycle, and a relaxation cycle, for each row of the display array, and wherein the drive system is configured to:

program, during the programming cycle, the pixel circuits on a row by activating the address line for the row so as to connect the pixel circuits in the row to respective data lines for conveying the voltage programming information;

partially discharge, during the discharge cycle, the voltage on the gate terminal of the drive transistor by deactivating the address line for the row and activating a control line for the row;

deactivate, during the emission cycle, the control line for the row and drive the light emitting device by the drive transistor according to the voltage remaining on the gate terminal of the drive transistor;

discharge, during the reset cycle, the voltage on the gate terminal of the drive transistor by activating the control line for the row; and deactivate, during the relaxation cycle, the control line for the row.

21. The display system according to claim 20, wherein the control line is an address line for a second row in the display array.

22. The display system according to claim 20, wherein the relaxation cycle and reset cycle are a portion of a frame time during which the pixel circuits in the row are turned off, and wherein the relaxation cycle immediately follows the reset cycle such that the drive transistors in the row are not stressed during the relaxation cycle and the drive transistors in the row recover while the pixel circuits in the row are turned off, to thereby reduce the aging of the drive transistors in the row.

23. The display system according to claim 20, wherein the light emitting device in each of the plurality of pixel circuits includes an organic light emitting diode.

24. A method of driving a display system including a pixel circuit having a light emitting device, a drive transistor for driving the light emitting device, a first switch transistor for programming the pixel circuit via a data line for providing voltage programming information, and a circuit for adjusting the gate voltage of the drive transistor to account for an aging of the pixel circuit, the circuit for adjusting including a discharging transistor having a resistance that changes as the pixel circuit ages, a gate terminal of the discharging transistor being connected to the gate terminal of the drive transistor at a node, the circuit for adjusting further including a second switch transistor connected between the discharging transistor and the gate terminal of the drive transistor, the method comprising:

programming the pixel circuit according to the voltage programming information by selecting the first switch transistor to couple the pixel circuit to the data line and thereby charge the node of the pixel circuit according to the voltage programming information conveyed via the data line;

at least partially discharging the node of the pixel circuit through the discharging transistor; and driving the light emitting device to emit light during an emission cycle according to the voltage on the node such that the average light emitted during the emission cycle is independent of the aging of the pixel circuit.

25. The method of claim 24, wherein at least a portion of the at least partially discharging is carried out during at least a portion of the driving such that the light emitting device is driven with a decreasing drive current during at least a portion of the emission cycle, the decreasing drive current having an average value during the emission cycle that is independent of the aging of the pixel circuit.

26. The method of claim 24, wherein the at least partially discharging is carried out following the programming.

27. The method of claim 26, wherein at least a portion of the driving is carried out following the at least partially discharging such that the driving is carried out according to the voltage remaining on the node following the at least partially discharging.

28. The method of claim 24, wherein the at least partially discharging the node includes selecting the second switch transistor to couple the gate terminal of the drive transistor to the discharging transistor to thereby discharge the voltage of the node through the second switch transistor and the discharging transistor.

29. The method of claim 28, further comprising:

programming a second pixel circuit in the display system while the first switch transistor in the pixel circuit is turned off, the second pixel circuit being similar to the pixel circuit, the programming the second pixel circuit including selecting a first switch transistor in the second pixel circuit to couple the second pixel circuit to the data line and thereby charge the node of the second pixel circuit according to voltage programming information conveyed via the data line.

30. The method of claim 29, wherein the at least partially discharging at least partially overlaps with the programming the second pixel circuit.

31. The method of claim 28, wherein the pixel circuit is a first pixel circuit and the display system further includes a second pixel circuit similar to the first pixel circuit, and wherein the first switch transistor of the second pixel circuit is operated by a select line common with a line operating the second switch transistor in the first pixel circuit such that the at least partially discharging the node of the first pixel circuit by selecting the select line simultaneously selects the first switch transistor in the second pixel circuit to program the second pixel circuit.

* * * * *